US006262701B1

(12) United States Patent
Okuda et al.

(10) Patent No.: US 6,262,701 B1
(45) **Date of Patent: *Jul. 17, 2001**

(54) ELECTRON-EMISSION DEVICE AND APPARATUS AND IMAGE-FORMATION USING SAME

(75) Inventors: Masahiro Okuda, Zama; Akira Asai, Atsugi; Shigeki Matsutani, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/565,871

(22) Filed: Dec. 1, 1995

(30) Foreign Application Priority Data

| | | |
|---|---|---|
| Dec. 5, 1994 | (JP) | 6-329295 |
| Jul. 12, 1995 | (JP) | 7-197965 |
| Nov. 27, 1995 | (JP) | 7-329431 |

(51) Int. Cl.[7] ..... G09G 3/22
(52) U.S. Cl. ..... 345/74; 345/75
(58) Field of Search ..... 345/74, 75, 76; 315/169.1, 169.3, 169.4; 313/336, 500, 351, 495, 496, 497

(56) References Cited

U.S. PATENT DOCUMENTS

| | | | | |
|---|---|---|---|---|
| 4,818,914 | * | 4/1989 | Brodie | 345/74 |
| 5,066,883 | | 11/1991 | Yoshioka et al. | 313/309 |
| 5,336,973 | | 8/1994 | Leroux et al. | 315/14 |
| 5,340,997 | | 8/1994 | Kuo | 257/10 |
| 5,530,314 | | 6/1996 | Banno et al. | 313/310 |

FOREIGN PATENT DOCUMENTS

| | | | |
|---|---|---|---|
| 0536732 | | 4/1993 | (EP) . |
| 0550335 | | 7/1993 | (EP) . |
| 0645794 | | 3/1995 | (EP) . |
| 2708380 | | 2/1995 | (FR) . |
| 1-031332 | | 2/1989 | (JP) . |
| 1-031335 | * | 2/1989 | (JP) . |
| 1-283749 | | 11/1989 | (JP) . |
| 2-257552 | | 10/1990 | (JP) . |
| 4-132137 | * | 5/1992 | (JP) . |
| 5-101769 | | 4/1993 | (JP) . |
| WO 92/09095 | | 5/1992 | (WO) . |
| WO 95/20821 | | 8/1995 | (WO) . |

OTHER PUBLICATIONS

M. Hartwell, C.G. Fonstad, "Strong Electron Emission From Patterned Tin–Idium Oxide Thin Films", IEOM, 1975, pp. 519–521.

G. Dittmer, "Electrical Conduction and Electron Emission of Discontinuous Thin Films", Thin Solid Films, Jul. 4, 1971, pp. 317–328.

H. Araki, et al., "Electroforming and Electron Emission of Carbon Films", Journal of the Vacuum Society of Japan, Sep. 24, 1981, pp. 22–29.

(List continued on next page.)

*Primary Examiner*—Xiao Wu
(74) *Attorney, Agent, or Firm*—Fitzpatrick, Cella, Harper & Scinto

(57) ABSTRACT

An electron-emitting device having an electron-emitting portion between a lower potential side electrode and a higher potential side electrode which are opposite to each other, the electron-emitting device including a field correction electrode disposed adjacent to the lower potential side electrode or the higher potential side electrode and capable of independently supplying a potential.

21 Claims, 26 Drawing Sheets

OTHER PUBLICATIONS

M. I. Elinson, "The Emission of Hot Electrons and the Field Emission of Electrons From Tin Oxides", Radio Engineering and Electronic Physics, Jul. 1965, pp. 1290–1296.
W.P. Dyke, W.W. Dolan, "Field Emission", Advances in Electronics and Electron Physics, 1956, pp. 90–185.
C.A. Spindt, et al., "Physical Properties of Thin–Film Field Emission Cathodes with Molybdenum Cones", Journal of Applied Physics, Mar. 18, 1976, pp. 5248–5263.
C.A. Mead, "Operation of Tunnel–Emission Devices", Journal of Applied Physics, Feb. 15, 1960, pp. 646–652.
The Experimental Physics Course No. 14: "Surface and Fine Particles", edited by Koreo Kinoshita; Kyoritu Publication 1986, pp. 193–195.
Chikara Hayashi, et al., "Ultrafine Particle Project—Creative Science and Technology", Mita Publication 1988, pp. 1–3.

* cited by examiner

ELECTRON-EMISSION DEVICE AND APPARATUS AND IMAGE-FORMATION USING SAME

BACKGROUND OF THE INVENTION

1. Field of the Invention

The present invention relates to an electron-emitting device, an electron source having a multiplicity of the foregoing electron-emitting devices disposed therein, and an image-forming apparatus, such as a display apparatus or an exposure apparatus, formed by using the electron source.

2. Related Background Art

Hitherto, electron-emitting devices have been classified into thermionic emission devices and cold cathode electron-emitting devices. The cold cathode electron-emitting devices include, in the category thereof, devices of field emitting type (hereinafter called "FE" type), devices of metal/insulating layer/metal type (hereinafter called "MIM" type) and surface conduction electron-emitting devices.

As the FE type devices, there have been known a device disclosed in W. P. Dyke and W. W. Dolan, "Field Emission", Advance in Electron Physics, 8, 89 (1956), a device disclosed in C. A. Spindt, "Physical Properties of thin-film field emission cathodes with molybdenum cones", J. Appl. Phys., 47, 5248 (1976) and so forth.

As the MIM type devices, there have been known a device disclosed in C. A. Mead, "Operation of Tunnel-Emission Devices", J. Appl. Phys., 32, 646 (1961) and so forth.

As the surface conduction electron-emitting device, there have been known a device disclosed in M. I. Elinson, Radio Eng. Electron Phys., 10, 1290 (1965) and so forth.

The surface conduction electron-emitting device uses a phenomenon emitting electrons when an electric current is allowed to flow in parallel to the surface of a thin film having a small area and formed on an insulating substrate. As the surface conduction electron-emitting device, there have been reported the foregoing device disclosed by Elinson and using the thin $SnO_2$ film, a device using a thin Au film [G. Duttmer: "Thin Solid Films", 9, 317 (1972)], a device using a thin $In_2O_3/SnO_2$ film [M. Hartwell and C. G. Fonstad: "IEEE Trans. ED Conf.", 519 (1975)], a device using a thin carbon film ["Vacuum" Vol. 26, 1st issue, p.p. 22, by Hisashi Araki et al. (1983)] and so forth.

The surface conduction electron-emitting device uses the phenomenon emitting electrons when an electric current is allowed to flow in parallel to the surface of a conductive film formed on an insulating substrate.

A typical structure of the surface conduction electron-emitting device is shown in FIGS. 28A and 28B. Note that structure shown in FIGS. 28A and 28B has been disclosed by the applicant of the present invention. Referring to FIGS. 28A and 28B, reference numeral 2001 represents a substrate, 2002 represents an electron-emitting portion, 2003 represents a conductive film including the electron-emitting portion 2002, and 2004 and 2005 represent electrodes of the device.

In the surface conduction electron-emitting device, the electron-emitting portion 2002 is usually previously formed in the conductive film 2003 made of conductive fine particles by an electric current flowing treatment called "forming". The forming process is usually performed by applying voltage to the two ends of the conductive film 2003 to locally rupture, deform or denature the conductive film 2003 so as to change the structure so that the electron-emitting portion 2002 in an electrically strong resistance state is formed. Note that a fissure is formed in a portion of the conductive film 2003 of the electron-emitting portion 2002, thus causing electrons to be emitted from the portion in the vicinity of the fissure.

The foregoing surface conduction electron-emitting device, having a simple structure as described above, has an advantage that a multiplicity of devices can be disposed over a large area. To use the foregoing characteristic, a variety of applied forms have been developed, for example, an application to an image-forming apparatus, such as a charged beam source or a display apparatus.

As a conventional structure having a multiplicity of surface conduction electron-emitting devices disposed therein, there is exemplified by an electron source having a structure such that surface conduction electron-emitting devices are disposed in parallel, the two ends of each of the surface conduction electron-emitting devices are connected by wires (also called "common wires") to form a row, and a multiplicity of the rows are disposed (also called a "ladder-type configuration")(refer to, for example, Japanese Patent Laid-Open Application No. 64-31332, Japanese Patent Laid-Open Application No. 1-283749 and Japanese Patent Laid-Open Application No. 2-257552).

As a display apparatus which can be formed into a flat display apparatus similar to a display apparatus using liquid crystal and with which a spontaneous light emitting type display apparatus that does not require a backlight can be formed, a display apparatus has been suggested which is formed by combining an electron source, comprising a multiplicity of surface conduction electron-emitting devices, with fluorescent members which emit visible rays when irradiated with electron beams emitted by the multiplicity of the electron sources (refer to U.S. Pat. No. 5,066,883).

Hitherto, devices caused to emit fluorescent light when irradiated with electrons emitted by the electron source formed by the multiplicity of the surface conduction electron-emitting devices have been selected in response to appropriate drive signals supplied to wires (called "row-directional wires"), in parallel, connecting the multiplicity of the surface conduction electron-emitting devices and to control electrodes (called "grids") disposed in a space between the electron-emitting devices and the fluorescent members, the grids being disposed perpendicular to the row-directional wires (refer to, for example, Japanese Patent Laid-Open Application No. 1-283749 laid open by the applicant of the present invention).

When the electron-emitting device for use in the electron source or the image-forming apparatus is operated for a long time, stable and controlled electron-emitting characteristics and improvement in the efficiency in emitting electrons have been required.

The foregoing efficiency is, in the case of the foregoing surface conduction electron-emitting device, the ratio of an electric current (hereinafter called a "device current If") flowing when voltage is applied to a pair of opposite device electrodes and an electric current (hereinafter called an "emitted current Ie") emitted into a vacuum. That is, the improvement in the electron-emitting efficiency is to reduce the device current If as possible and to enlarge the emitted current Ie as possible. If stable and controlled electron-emitting characteristics are obtained and the efficiency in emitting electrons is improved, an image-forming apparatus comprising, for example, fluorescent members as image-forming elements thereof can be formed into a bright and high-grade image-forming apparatus requiring a small electric current, for example, a flat TV monitor can be realized.

Furthermore, since only a small electric current is required, the overall cost of the drive circuit and the like forming the image-forming apparatus can be reduced.

SUMMARY OF THE INVENTION

The present invention has been achieved in the light of the above-mentioned state of affairs, and is aimed to provide an electron-emitting device capable of realizing an improved electron-emitting efficiency and having a novel structure, an electron source having a multiplicity of the electron-emitting devices and an image-forming apparatus having the electron source.

According to an aspect of the present invention, there is provided an electron-emitting device including a conductive film having an electron-emitting portion between a lower potential side electrode and a higher potential side electrode, which are opposite to each other, the electron-emitting device comprising: a field correction electrode disposed adjacent to the lower potential side electrode or the higher potential side electrode and capable of independently supplying a potential.

According to another aspect of the present invention, there is provided an electron source having a substrate on which a plurality of the electron-emitting devices are disposed.

According to still another aspect of the present invention, there is provided an image-forming apparatus comprising an electron-emitting device, an image-forming member, and a unit for operating the electron-emitting device such that an electron beam emitted from the electron-emitting device is controlled in response to an information signal.

Other and further objects, features and advantage of the invention will be appear more fully from the following description.

DETAILED DESCRIPTION OF THE PREFERRED EMBODIMENTS

Figure 29:
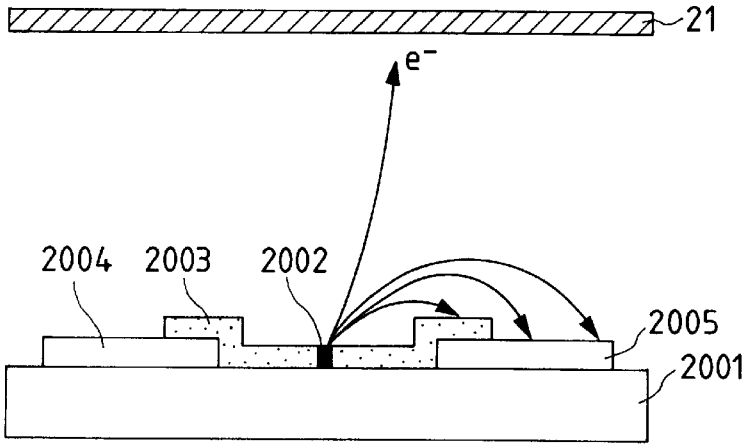
FIG. 29 is a diagram showing attraction of emitted electrons to the device electrode occurring with the surface conduction electron-emitting device having no field correction electrode.

In an electron-emitting device as shown in FIG. 29, the structure causes electrons temporarily emitted from an electron-emitting portion 2002 into a vacuum to be, at high rate, trapped by a high potential portion of a conductive film 2003 located considerably near the emission position or the high-potential-side device electrode 2005. Therefore, electrons cannot reach an anode electrode 21, thus causing the efficiency in emitting electrons to be lowered. If an electron-emitting device suffering from a poor electron-emitting efficiency is used in an image-forming apparatus, a large device current If is required to obtain a required emission current. As a result, the electric power consumption cannot be reduced or the voltage drops excessively due to the resistance of the wires, thus causing irregular brightness to take place.

The present invention has been achieved in view of the foregoing.

As described above, the present invention relates to an electron-emitting device, an electron source having a plurality of the electron-emitting devices and an image-forming apparatus using the electron source. The structure and the operation of the present invention will now be described.

The electron-emitting device according to the present invention is classified as the foregoing cold cathode electron-emitting device. Among various types of the cold cathode electron-emitting devices, a surface conduction electron-emitting device is preferably employed in view of obtaining desired electron-emitting characteristics. Accordingly, the surface conduction electron-emitting device will now be described.

Figure 1A:
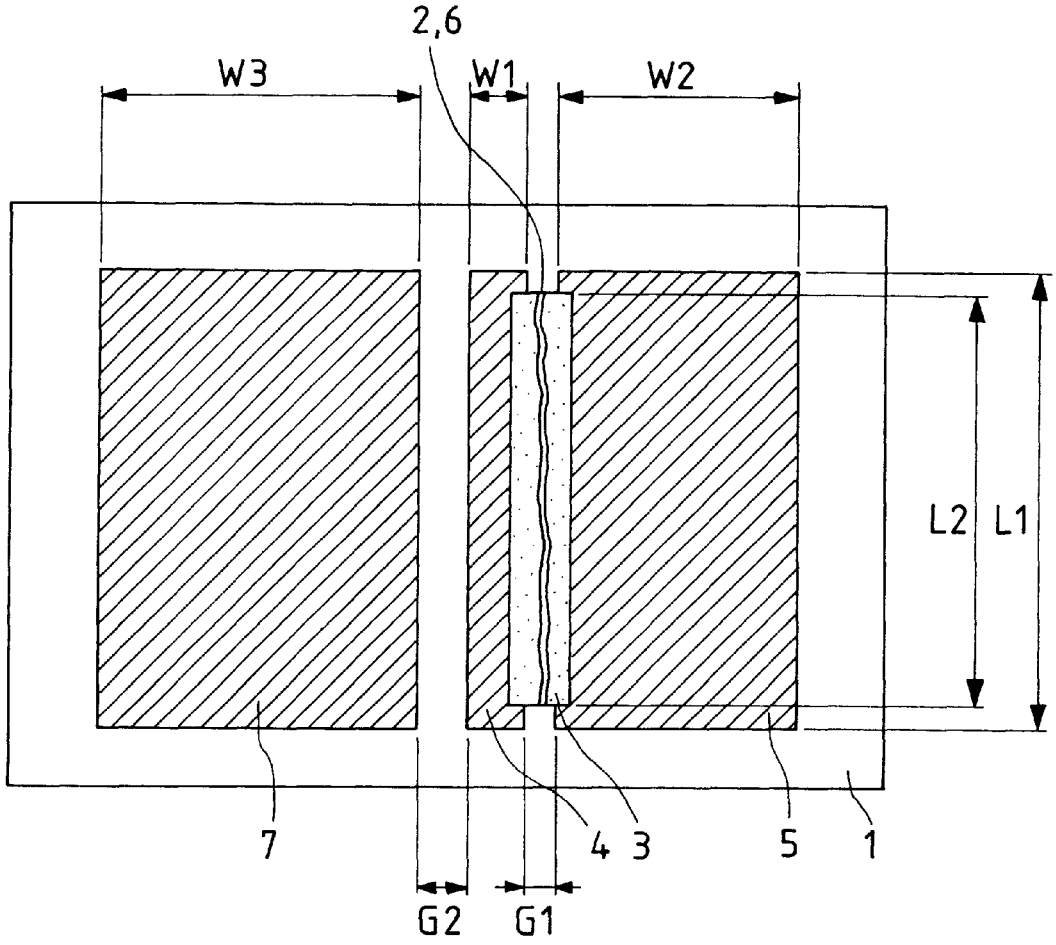
FIGS. 1A and 1B respectively are a plan view and a vertical cross sectional view each schematically showing an example of a surface conduction electron-emitting device serving as an example of an electron-emitting device according to the present invention.
Figure 1B:
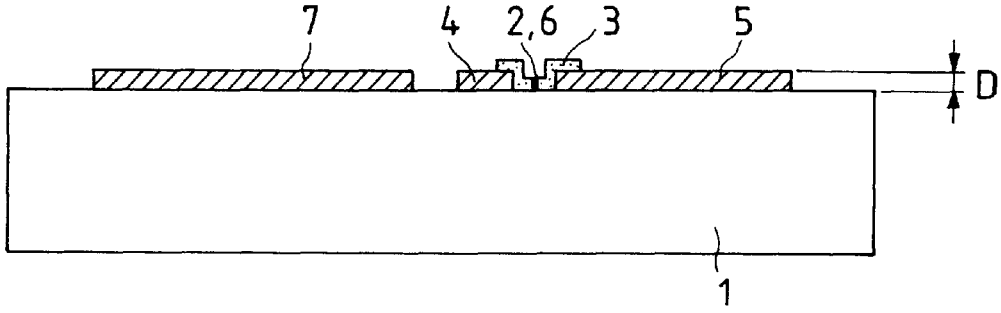

An example of the basic structure of the surface conduction electron-emitting device according to the present invention is shown in FIGS. 1A and 1B. Referring to FIGS. 1A and 1B, reference numeral 1 represents a substrate, 2 represents an electron-emitting portion including a fissure 6, 3 represents a conductive film, 4 represents a lower potential side device electrode, 5 represents a higher potential side device electrode, and 7 represents a field correction electrode.

The substrate 1 is made of material exemplified by quarts glass, glass in which the quantity of impurities, such as Na, is reduced, soda lime glass, a laminated plate formed by laminating $SiO_2$ on soda lime glass by sputtering or the like and ceramics such as alumina.

The material of the opposite device electrodes 4 and 5 and the field correction electrode 7 is a usual conductive material exemplified by metal, such as Ni, Cr, Au, Mo, W, Pt, Ti, Al, Cu and Pd, or their alloys, a printed conductor formed by metal, such as Pd, Ag, Au, $RuO_2$ or Pd—Ag or their metal oxides and glass, a transparent conductor, such as $In_2O_3$—$SnO_2$, and semiconductor material, such as polysilicon.

Interval G1 between device electrodes is several hundreds of Å to several hundreds of μm, the interval G1 being determined depending upon the performance of photolithography technique, which is the base for manufacturing the device electrodes, that is, the performance of an exposing machine, the employed etching method and voltage to be applied between the device electrodes 4 and 5. It is preferable that the interval G1 is several μm to tens of μm.

Length L1 of the device electrode and thickness D of the device electrode are determined in consideration of the resistance value of the electrode and limitation in the configuration of the multiplicity of the disposed electron sources. The length L1 of the device electrode is usually several μm to several hundreds of μm, while the thickness D of the device electrode is several hundreds of Å to several μm.

Width W1 of the lower potential side device electrode 4 is several hundreds of nm to several hundreds of μm, the width W1 being determined depending upon various parameters, such as device voltage Vf to be applied between the device electrodes 4 and 5, anode voltage Va to be applied to an anode electrode 21 as shown in FIG. 29 to raise electron emitted from the electron-emitting portion 2 and distance h from the anode electrode to the electron-emitting device.

Interval G2 from the lower potential side device electrode 4 to the field correction electrode 7 is several hundreds of Å to several hundreds of μm, the interval G2 being, similarly to the foregoing interval G1 between device electrodes, determined depending upon the performance of photolithography technique, which is the base for manufacturing the device electrodes, that is, the performance of an exposing machine, the employed etching method and voltage to be applied between the device electrodes 4 and 5. It is preferable that the interval G2 is several μm to tens of μm. Width W3 of the field correction electrode 7 is determined to be an appropriate value ranging from several hundreds of Å to tens of mm.

The conductive film 3 is made of a material selected from a group consisting of metal, such as Pd, Pt, Ru, Ag, Au, Ti, In, Cu, Cr, Fe, Zn, Sn, Ta, W or Pb; an oxide, such as PdO, $SnO_2$, $In_2O_3$, PbO or $Sb_2O_3$; a boride, such as $HfB_2$, $ZrB_2$, $LaB_6$, $CeB_6$, $YB_4$ or $GdB_4$; a carbide, such as TiC, ZrC, HfC, TaC, SiC or WC; a nitride, such as TiN, ZrN or HfN; a semiconductor, such as Si or Ge; and carbon.

It is further preferable that the conductive film 3 is a fine particle film formed by fine particles to obtain excellent electron-emitting characteristics. The thickness of the conductive film 3 is determined to be an appropriate value depending upon the step coverage on the device electrodes 4 and 5, the resistance values of the electron-emitting portion 2 and between the device electrodes 4 and 5, the particle size of the conductive fine particles of the electron-emitting portion 2 and forming conditions to be described later. It is preferable that the thickness of the conductive film 3 is several Å to thousands of Å, more preferably 10 Å to 500 Å. The resistance value of the conductive film 3 is sheet resistance value of $10^3$ to $10^7$ Ω/square.

The "fine particle film" is a film formed by aggregating a plurality of fine particles and has a fine structure such as a structure in which particles are individually dispersed and located, and a structure in which particles are located adjacent or overlapped (including a case where some particles are aggregated and an island structure is formed as the overall structure). In the case of the fine particle film, it is preferable that the particle size is several Å to thousands of Å, more preferably 10 Å to 500 Å.

The meaning of the term "fine particle" employed in this specification will now be described.

Small particles are called "fine particles", while particles having further smaller sizes are called "ultra fine particles". A substances having a size smaller than the "ultra fine particles" and containing atoms by a number smaller than several hundreds is usually called a "cluster".

However, the borders of the foregoing particles cannot be strictly defined and, thus, the category is varied depending upon the characteristic to which attention is paid. The "fine particles" and the "ultra fine particles" are sometimes collectively called as "fine particles". The description made in this specification will be made on the basis of the foregoing concept.

For example, in "Surface and Fine Particles", Vol. 14 of "Lectures of Experimental Physics" edited by Koreo Kinoshita published by Kyoritsu on the 1st day of Sep., 1986, there has been described "the term "particles" employed in this thesis have diameters of about 2 μm to 3 μm to about 10 nm, and "ultra fine particles" have diameters of about 10 nm to about 2 nm to 3 nm. If the particles of the foregoing types are collectively called fine particles, the border cannot be strictly defined. A substance having tens to several hundreds of atoms forming the particle is called a "cluster" " (refer to lines 22 to 26 at page 195).

Furthermore, in "Ultra Fine Particle Project", Hayashi, New Technology Development Association, the "ultra fine particles" are defined to be particles further smaller particle sizes as follows.

In "Ultra Fine Particles Project" (1981 to 1986) in Creative Science Technology Promotion System, particles having a size (a diameter) of about 1 nm to 100 nm are called "ultra fine particles". Accordingly, one ultra fine particle is an aggregate of about 100 to $10^8$ atoms. In viewpoint of atoms, the ultra fine particle is a large to ultra large particle. "Ultra Fine Particle-Creative Science Technology", edited by Chikara Hayashi, Ryoji Ueda and Akira Tazaki, Mita Shuppan, 1988, lines 1 to 4, p.p. 2/"particles smaller than ultra fine particles, that is, one particle formed by several to several hundreds of atoms is usually called a "cluster" " (refer to lines 12 and 13, p.p. 2).

On the basis of the foregoing general definition, the "fine particle" in this specification is an aggregate of a multiplicity of atoms or molecules having a lower limit of the particle size of about several Å to about 10 Å and an upper limit of the same of about several $\mu$m.

The electron-emitting portion 2 includes the fissure 6 so that electrons are emitted in a portion adjacent to the fissure 6. The electron-emitting portion 2 including the fissure 6 and the fissure 6 are formed depending upon the thickness, characteristic, and the material of the conductive film 3 and the manufacturing method, such as forming conditions, to be described later. Therefore, the position and shape of the electron-emitting portion 2 are not limited to those shown in FIGS. 1A and 1B.

The fissure 6 sometimes includes conductive fine particles each having a particle size of about several Å to about several hundreds of Å. The conductive fine particles are portions of an element or all elements forming the conductive film 3. The electron-emitting portion 2 including the fissure 6 and the conductive film 3 adjacent to the electron-emitting portion 2 sometimes have films, the main component of which is carbon.

When the surface conduction electron-emitting device according to the present invention having the foregoing structure is operated, the potential to be applied to the field correction electrode 7 is appropriately determined so that deterioration in the electron-emitting efficiency occurring due to sucking of electrons emitted by the electron-emitting portion 2 into the higher potential side device electrode 5 can be prevented. The principle of the foregoing phenomenon will now be described with reference to FIGS. 2 and 3.

Figure 2:
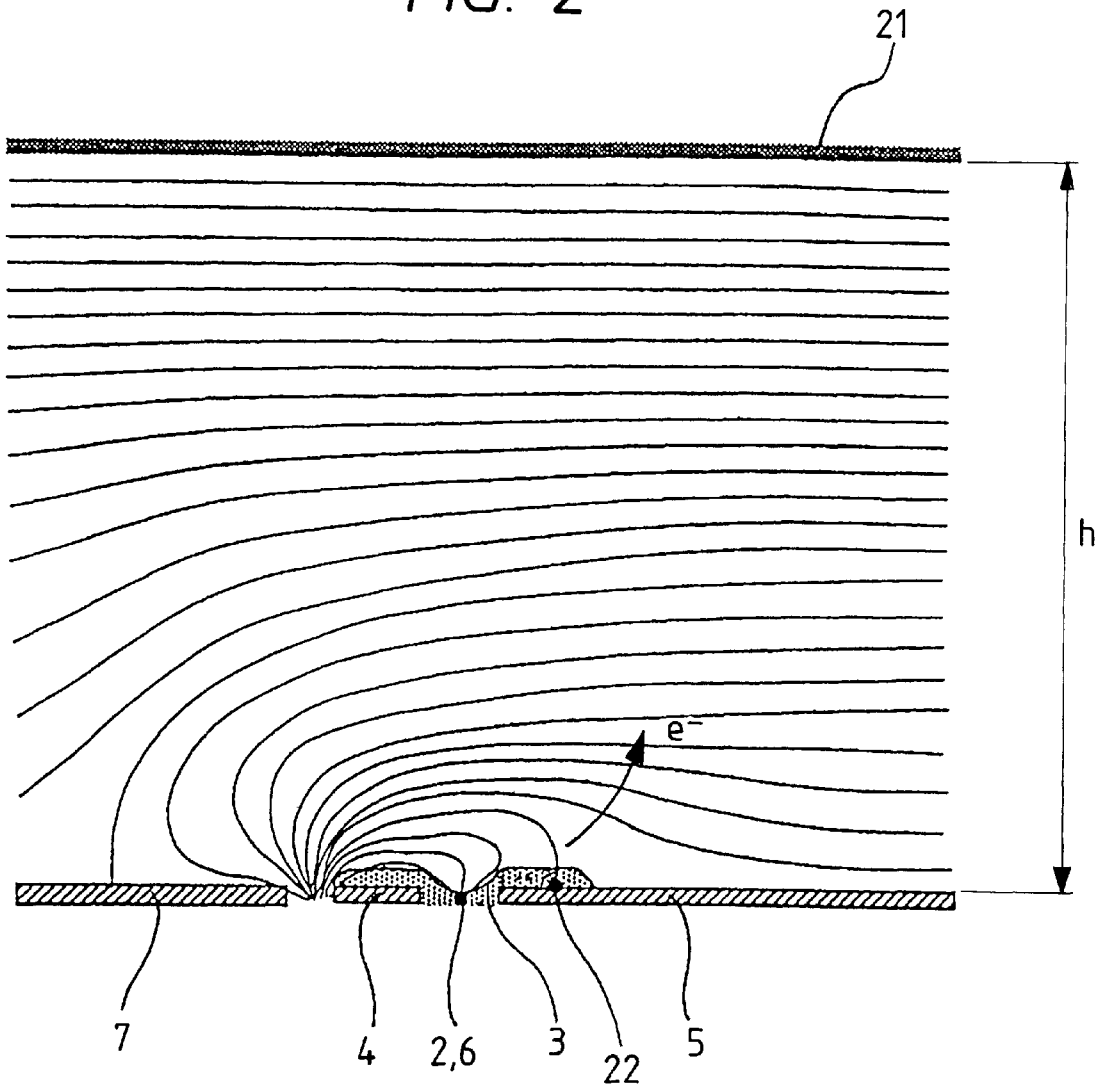
FIG. 2 shows potential distribution for explaining an effect of a field correction electrode in the electron-emitting device according to the present invention.
Figure 3:
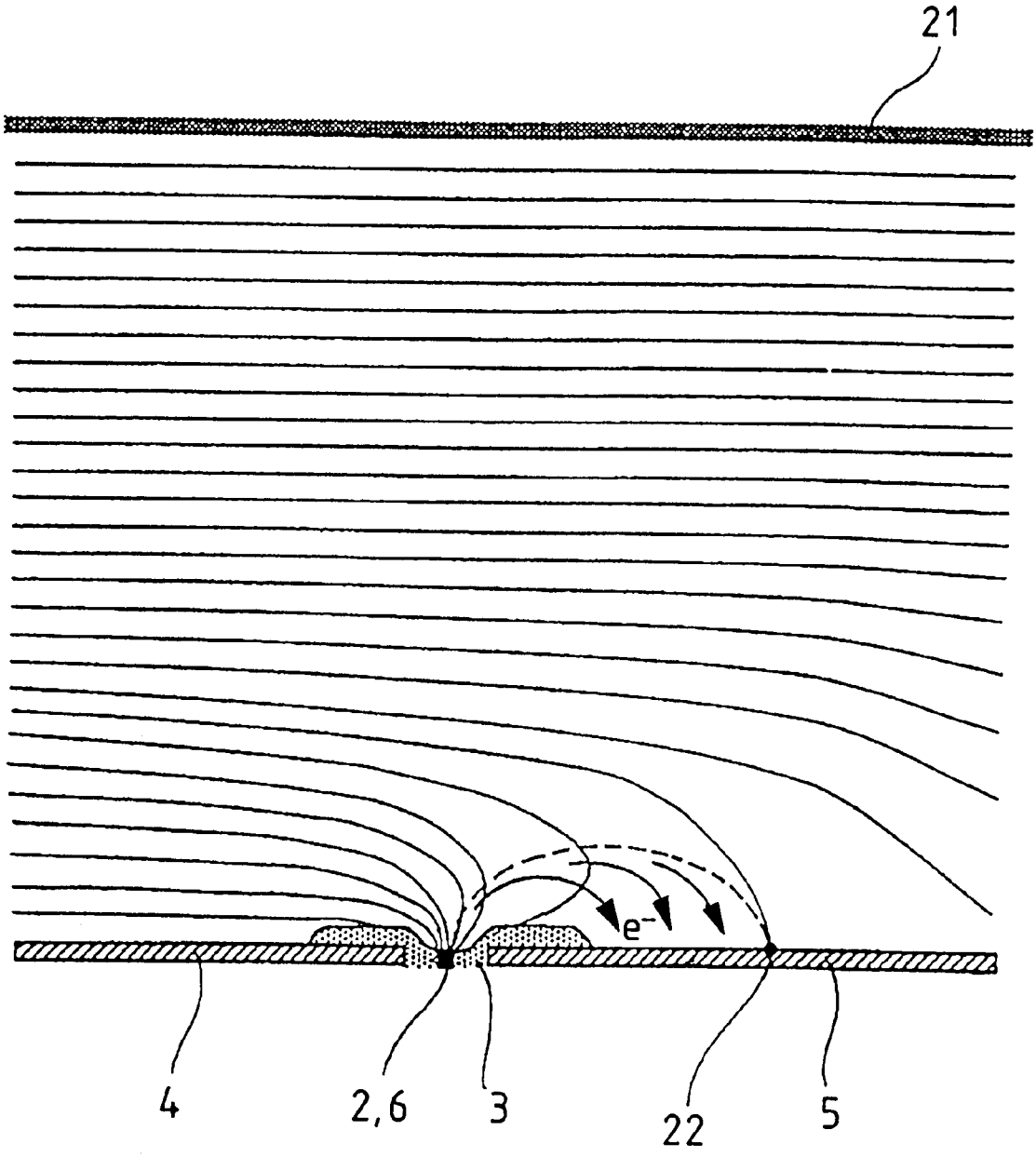
FIG. 3 shows potential distribution in a surface conduction electron-emitting device having no field correction electrode.
Figure 28A:
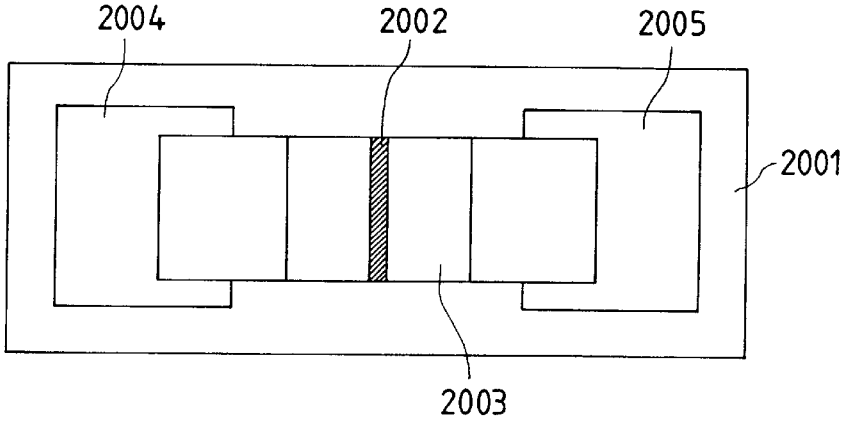
FIG. 28A PRIOR ART
FIGS. 28A and 28B are diagrams showing the structure of a surface conduction electron-emitting device having no field correction electrode.
Figure 28B:
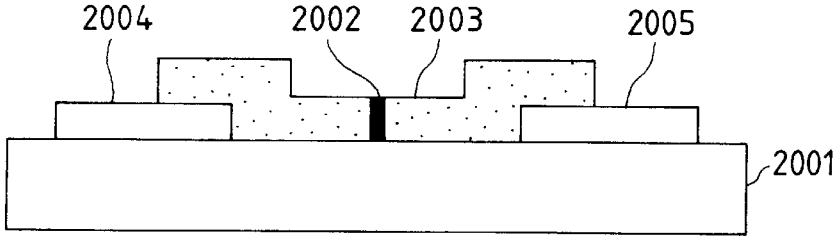
FIG. 28B PRIOR ART

FIG. 2 shows potential distribution realized along device electrodes when viewed on a vertical cross section (the same cross section as that of FIG. 1B) of the surface conduction electron-emitting device according to the present invention. FIG. 3 shows potential distribution realized along the device electrodes of a conventional device shown in FIGS. 28A and 28B. Referring to the foregoing drawings, reference numeral 21 represents an anode electrode (anode plate) for raising electrons emitted by the electron-emitting portion. In an actual case where the surface conduction electron-emitting device is adapted to an image-forming apparatus, potential Va of the anode electrode 21 is about 1 kV to about 10 kV, while distance h from the substrate, on which the electron-emitting device has been formed, is about several mm. When the device is operated, device voltage Vf of about 10 V to about 20 V is applied between the device electrodes 4 and 5.

In the case of the device (see FIGS. 28A and 28B) from which the field correction electrode 7 (see FIGS. 1A and 1B) is omitted, a potential distribution, realized when the device is operated, has, on the higher potential side device electrode 5, a singular point 22 considerably apart from the position of the fissure 6, as shown in FIG. 3. In the region from the singular point 22 to the electron-emitting point, the electric field faces upwards (faces the anode electrode 21) as shown in FIG. 3. Since electrons emitted from the electron-emitting point therefore receive downward force (in a direction toward the higher potential side device electrode 5), electrons, that have not sufficiently large upward kinetic energy, cannot pass through the foregoing region but the electrons falls onto the higher potential side device electrode 5.

On the other hand, the electron-emitting device according to the present invention (see FIGS. 1A and 1B) comprises the field correction electrode 7 on the outside of the lower potential side device electrode 4, the field correction electrode 7 being enabled to be set to a potential, that is different from the voltage to be applied to the lower potential side device electrode 4. Therefore, appropriate setting of the potential of the field correction electrode 7 enables the potential distribution in a region which reaches the singular point to be set somewhat arbitrarily.

Specifically, by setting the potential to be applied to, for example, the field correction electrode 7 to be higher than the potential to be applied to the lower potential side device electrode 4, the ratio of electrons which are able to reach the anode electrode can be raised. The reason for this is that setting of the potential to be applied to the field correction electrode 7 to be higher than that to be applied to the lower potential side device electrode 4 causes the position of the singular point 22 of the electric field to approach a position near the fissure 6 as shown in FIG. 2, and thus the region, in which temporarily emitted electrons receive the downward force, is reduced, so that electrons fallen onto the higher potential side device electrode 5 are attracted to the anode electrode 21.

The electric field correction, to which the electron-emitting device according to the present invention is subjected, and the effect of the same on the forbid of emitted electrons will now be described further in detail.

According to experiments performed by the inventors of the present invention for examining the electric field distribution in the case where voltages are respectively applied to the surface conduction electron-emitting device and the anode electrode that opposes the surface conduction electron-emitting device and calculations for obtaining the orbit of electrons, a fact was found that the following assumptions enable the results of the experiment to be explained to a somewhat extent.

1. In the fissure of the surface conduction electron-emitting device, electron are temporarily emitted from a position of the fissure adjacent to the anode into a vacuum on the outside of the anode.

2. The temporarily emitted electrons move in an electric field formed by the cathode and anode, and electrons reached the positions farther than the singular point (a stagnation point) in the electric field on the higher potential side device electrode (or the conductive film adjacent to the anode) are attracted to an anode plate by the electric field formed by the voltage applied to the anode plate.

3. Electrons, which do not reach the singular point in the electric field, fall onto the anode and, thus, a portion of the electrons scatters at that portion, followed by being again emitted to the vacuum. The foregoing scattering operation is repeated so that electrons exceeded the singular point in the electric field reach the anode plate.

A fact can be understood that the electron-emitting efficiency can be improved significantly by setting the electric field conditions for the foregoing electron-emitting mechanism such that the major portion of the temporarily emitted electrons does not fall onto the anode but the electrons are attracted to the anode plate. A specific design method to adjust a variety of parameters to satisfy the foregoing requirement will now be described.

In the surface conduction electron-emitting device having no field correction electrode (see FIGS. 28A and 28B), the singular point in the electric field is generated at a position apart from the position of the fissure formed in the conductive film 2003 for a distance Xs expressed by the following Equation (1):

$$Xs = \frac{d}{2}\sqrt{1+\left(\frac{2hV_f}{\pi V_a d}\right)^2} \approx \frac{hV_f}{\pi V_a} \tag{1}$$

where h is the distance from the surface conduction electron-emitting device to the anode plate, π is the ratio of the circumference of a circle of its diameter, d is the width of the fissure, Vf is voltage to be applied to the device and Va is voltage to be applied to the anode.

In the foregoing Equation (1), the second approximate equality sign is held in the case where Vf/d>>Va/h (it can easily be held in the case of a usual surface conduction electron-emitting device), where d is an effective width of the fissure.

As a result of calculations of the motion of electrons in the region inner than the singular point in the electric field, when electrons are, with certain kinetic energy, emitted from the anode adjacent to the fissure, the emitted electrons are able to fly on the anode by a distance which is not more than C times the distance from the emission position to the central portion of the fissure if no scattering at the anode takes place. Note that symbol C indicates a parameter which is determined depending upon the kinetic energy of the electron expressed by the following Equation (2) realized when the electron is emitted, the parameter C being a parameter obtained from detailed calculations performed by the inventors of the present invention.

$$C = \exp\left\{-5.6\left(\frac{eV_f}{W_f+eV_f}\right)^2 + 27.3\left(\frac{eV_f}{W_f+eVf}\right) - 12.2\right\} \tag{2}$$

where Vf [V] is voltage to be applied between said cathode-side electrode and said higher potential side electrode, Wf [eV] is a work function of a substance near said fissure and e [C] is an elementary electric charge.

Accordingly, the conditions for at least a portion of the electrons temporarily emitted into the vacuum to reach the anode plate without falling onto the anode are expressed by the following Equation (3).

$$CL > xs \tag{3}$$

where L is the distance from a position, at which the electron is, on the anode, initially emitted, to the central portion of the fissure. The distance is considered to be expressed, as an average value, by the following Equation (4) by using the effective width d of the fissure and the mean free path λ for the scattered electron:

$$L = \frac{d}{2} + \lambda \tag{4}$$

The distance CL is the distance calculated on the basis of experiments in such a manner that a device, manufactured by performing forming by using a thin conductive film or a material of a device electrode having a very low elastic scattering efficiency, is operated for a certain period with a predetermined voltage in a vacuum atmosphere in which organic substances exist as described later (however, no anode is provided or the anode voltage Va=0), the distance CL being distance from carbon among carbon deposited on the higher potential side device electrode or the thin conductive film, which is located farthest from the position of the fissure, to the position of the fissure.

In a typical example of the surface conduction electron-emitting device having no field correction electrode, assuming that Vf≅15 (V), h≅5 (mm), Va≅5 (kV) and Wf≅4 (eV), calculation is performed as to whether the foregoing conditions are met. As a result, CL≅0.3 (μm) and xs≅5 (μm), which are out of the conditions expressed by the foregoing Equation (3). If the anode voltage Va is changed to satisfy the foregoing conditional equation, anode voltage Va of tens of kV to several hundreds of kV must be applied. Therefore, application to an image-forming apparatus or the like has been impossible in consideration of easiness in occurring discharge.

In the case of the structure of the surface conduction electron-emitting device shown in FIGS. 1A and 1B, assuming that the voltage to be applied to the field correction electrode 7 is Vc, the singular point in the electric field concerning the emission of electron can be, on the anode, set to a position apart from the position of the fissure 6 by distance xs expressed by the following Equation (5).

$$x_s = \frac{-\pi b V_a - hV_c + hV_f + \sqrt{(-\pi b V_a - hV_c + hV_f)^2 + 4\pi b h V_a V_f}}{2\pi V_a} \tag{5}$$

where b is the distance from the position of the fissure to the central portion of the gap between the device electrode and the field correction electrode. The other parameters are the same as those in the foregoing Equations (1) to (4).

The foregoing equation can be simplified as follows if the voltage Vc to be applied to the field correction electrode is high.

$$xs \approx \frac{hV_f}{\pi\left(V_a + \frac{h}{\pi b}V_c\right)} \tag{6}$$

The foregoing equation (6) indicates a fact that the same effect for the singular point obtainable from raising the anode voltage Va can be obtained from raising the voltage Vc to be applied to the field correction electrode. Since the field correction electrode 7 is located considerably adjacent to the electron-emitting portion 2 as compared with the anode electrode 21, a significant effect can be expected with low voltage. In the case of the same structure as that of the conventional surface conduction electron-emitting device except the field correction electrode 7 being provided, setting of the voltage Vc to be applied to the field correction electrode 7 to be+tens of V to+several hundreds of V enables the foregoing condition (Equation (3)) to be satisfied.

A similar effect can be expected in the case where the field correction electrode 7 is located on the outside of the higher potential side device electrode 5. In the foregoing case, the singular point in the electric field to be formed on the higher potential side device electrode 5 determines whether or not the electron is able to reach the anode electrode 21. If Vc is at a certain level, the singular point in the electric field is approximately expressed by the following Equations (7) and (8):

$$x_s = \frac{\pi b V_a - hV_c + hV_f + \sqrt{(\pi b V_a + hV_c + hV_f)^2 + 4\pi b h V_a V_f}}{2\pi V_a} \tag{7}$$

$$x_s \approx \frac{hV_f}{\pi\left(V_a + \frac{h}{\pi b} V_c\right)} \tag{8}$$

Namely, if the voltage Vc to be applied to the field correction electrode 7 is high in the case where the field correction electrode 7 is located outside the higher potential side device electrode 5, a design method similar to that employed in the case where the field correction electrode 7 is located outside the higher potential side device electrode 5 can be employed.

As described above, it is preferable for the present invention that the parameters Vf, Va, Vc, L, h, b, Wf are set to satisfy the foregoing conditional equations. As a result, electrons temporarily emitted from the anode near the fissure into a vacuum due to scattering or the like do not fall onto the anode but the electrons reach the anode electrode 21 with a further high probability, thus resulting in the electron-emitting efficiency to be improved significantly.

An example of a method of manufacturing the basic structure of the surface conduction electron-emitting device according to the present invention will now be described with reference to FIGS. 4A to 4C. Note that reference numerals shown in FIGS. 4A to 4C which are the same as those shown in FIGS. 1A and 1B represent the same elements.

(1) The substrate 1 is sufficiently washed with detergent, pure water and an organic solvent, and then the material of the device electrode is deposited by a vacuum evaporating method, a sputtering method or the like. Then, photolithography technique is employed to form the device electrodes 4 and 5 and the field correction electrode 7 on the surface of the substrate 1 (see FIG. 4A).

(2) Organic metal solution is applied to the surface of the substrate 1 having the device electrodes 4 and 5, and the substrate 1 is allowed to stand. Thus, the device electrodes 4 and 5 are connected to each other so that an organic metal film is formed. Note that the organic metal solution is solution of an organic compound, the main element of which is the metal which forms the foregoing conductive film 3. Then, the organic metal film is subjected to a heat baking process, and the conductive film 3 patterned by a lifting off method and an etching method (see FIG. 4B).

Although the method of applying the organic metal solution has been described, the method is not limited to this. For example, a vacuum evaporation method, a sputtering method, a chemical gas phase deposition method, a dispersion application method, a dipping method or a spinner method may be employed.

(3) Then, a forming process is performed. As an example of the forming process, an electric current flowing treatment will now be described. The forming process according to the present invention is not limited to this. Any method may be employed if the selected method is a method of forming a strong resistance state by generating a fissure in the conductive film 3.

Figure 4A:
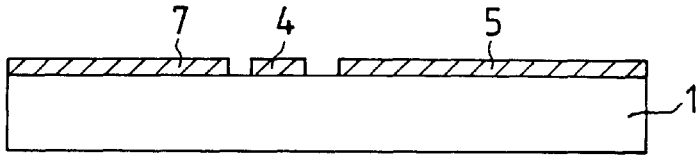
FIGS. 4A to 4C are diagrams showing a method of manufacturing the surface conduction electron-emitting device shown in FIGS. 1A and 1B.
Figure 4B:
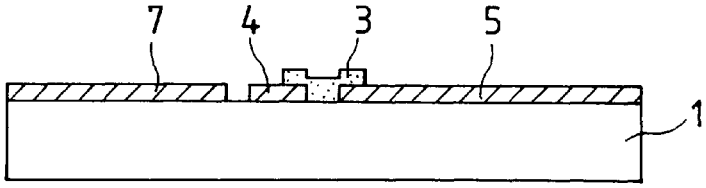
Figure 4C:
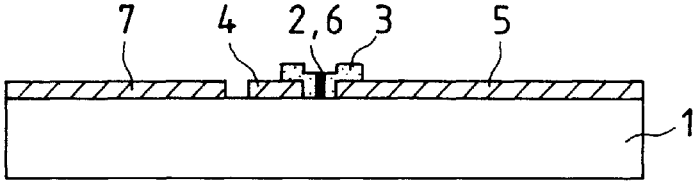

When electric power is supplied between the device electrodes 4 and 5 from a power source (not shown), the electron-emitting portion 2, the structure has been changed, is formed in the position of the conductive film 3 (see FIG. 4C). As a result of the foregoing electric current flowing treatment, the conductive film 3 is locally ruptured, deformed or denatured so that the structure of the electron-emitting portion 2 is changed.

Figure 5A:
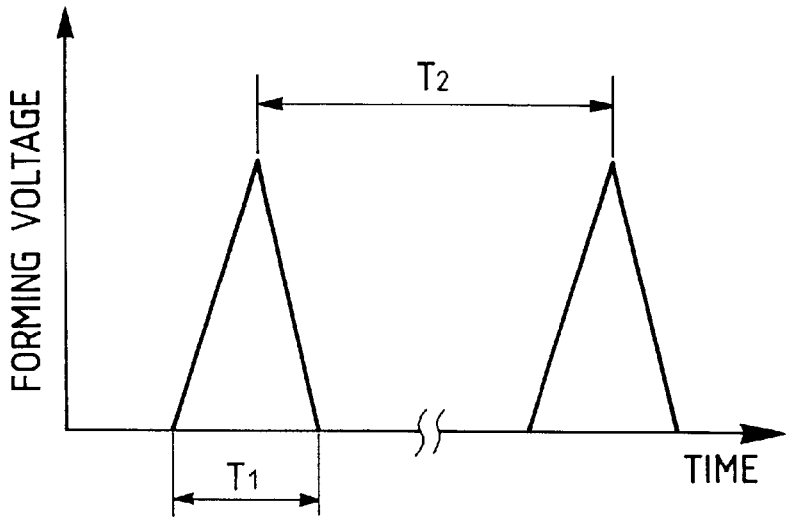
FIGS. 5A and 5B are graphs showing examples of voltage waveforms for use in a forming process.
Figure 5B:
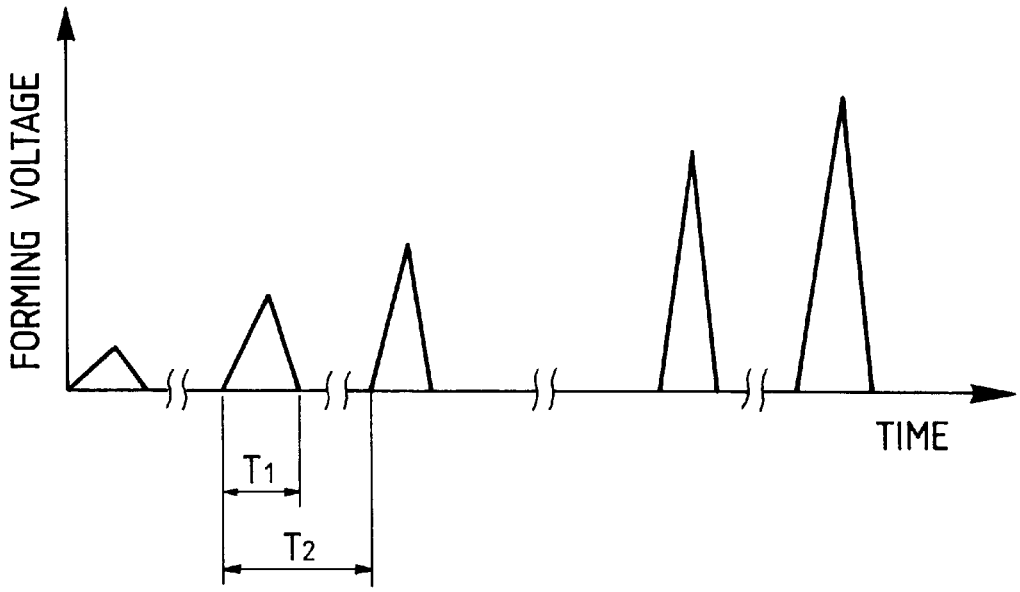

An example of the voltage waveform in the energization forming treatment is shown in FIGS. 5A and 5B.

It is preferable that the voltage waveform is in the form of pulse wave. The voltage pulses are applied by a method such that voltage pulses, the constant voltage of which is the high level of the pulse wave, are continuously applied (see FIG. 5A) or by a method such that the voltage pulses are applied in such a manner that the high level of the pulse wave are raised (see FIG. 5B).

The case where the high level of the pulse wave is made to be the constant voltage will now be described with reference to FIG. 5A.

Referring to FIG. 5A, T1 and T2 respectively are the pulse width and the pulse interval of the voltage waveform. For example, T1 is set to 1 $\mu$s to 10 ms, T2 is set to 10 $\mu$s to 100 ms, an appropriate wave height (the peak voltage in the forming process) is selected to be adaptable to the shape of the electron-emitting device and the thus-set voltage waveform is applied in a vacuum atmosphere having an appropriate degree of vacuum for several seconds to tens of minutes. The voltage waveform to be applied is not limited to the illustrated triangular wave. A desired waveform, such as a rectangular wave, may be employed. Also the wave height, pulse width and the pulse interval are not limited to the foregoing values. Thus, desired values may be selected to be adaptable to the resistance value of the electron-emitting device to form the satisfactory electron-emitting portion 2 as desired.

The case where the voltage pulses are applied while raising the high level of the pulse wave will now be described with reference to FIG. 5B.

Referring to FIG. 5B, T1 and T2 are the same as those shown in FIG. 5A. The wave height (the peak voltage in the forming process) is raised by, for example, each 0.1 V and the voltage pulses are applied in an appropriate vacuum atmosphere similar to that shown in FIG. 5A.

It is preferable that voltage, for example, about 0.1 V, that does not locally rupture, deform or denature the conductive film 3 is used to measure the device current during the pulse interval T2 to obtain the resistance value so as to complete the forming process if resistance stronger than, for example, 1 MΩ is measured.

Figure 6:
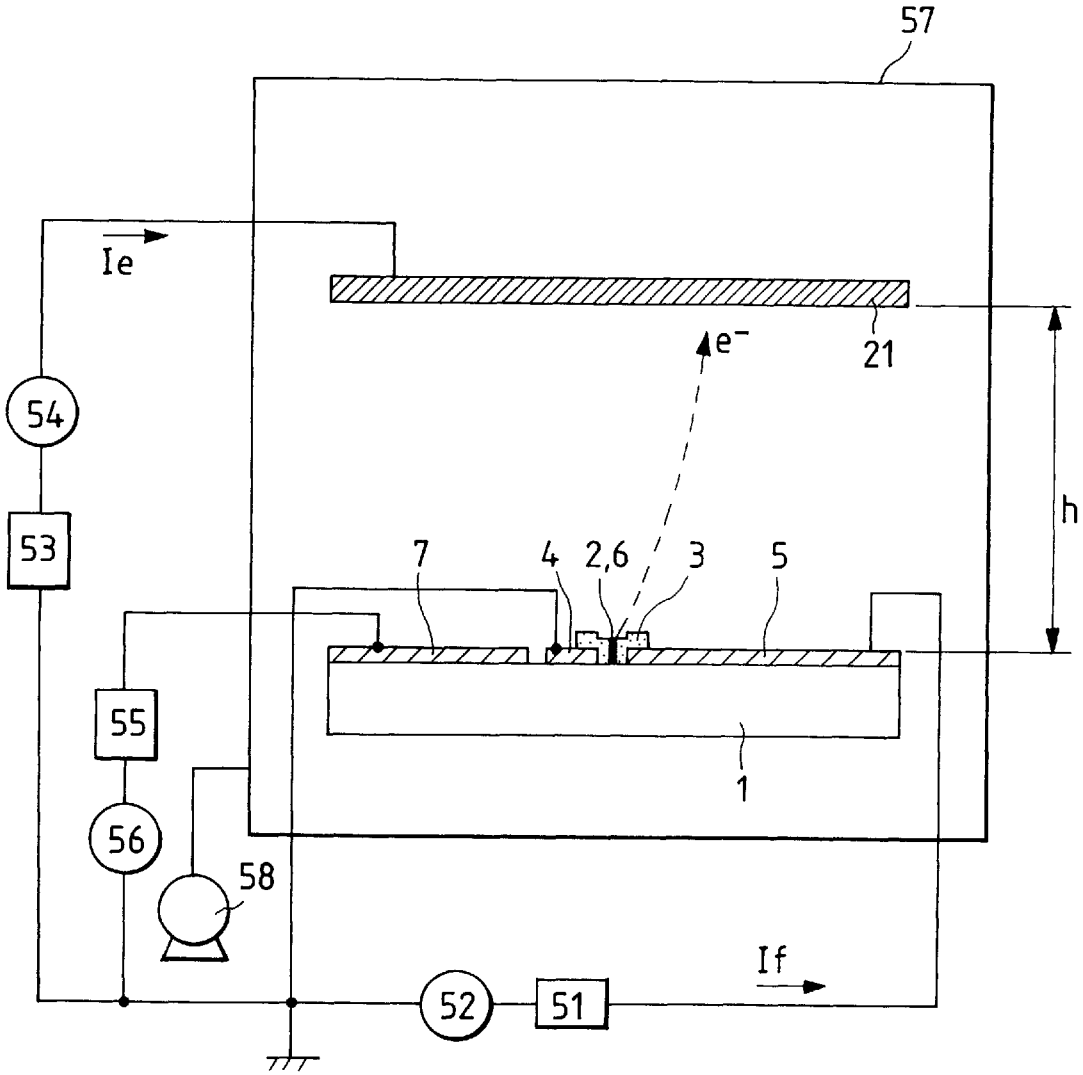
FIG. 6 is a schematic view showing an example of the structure of a measuring evaluation system for measuring the electron-emitting characteristic of the surface conduction electron-emitting device according to the present invention.

The processes following the forming process may be performed in a measuring evaluation system as shown in FIG. 6. The measuring evaluation system will now be described.

Referring to FIG. 6, the same reference numerals as those shown in FIGS. 1A and 1B represent the same elements. Reference numeral 21 represents an anode electrode for trapping emitted current Ie from the electron-emitting portion 2, 51 represents a power source for applying device voltage Vf to the device, 52 represents an ammeter for measuring device current If flowing in the conductive film 3 between the device electrodes 4 and 5, 53 represents a high-voltage power source for applying voltage to the anode electrode 21, 54 represents an ammeter for measuring emitted current Ie from the electron-emitting portion 2, 55 represents a power source for applying voltage to the field correction electrode 7, 56 represents an ammeter for detecting an electric current flowing in the field correction electrode 7, 57 represents a vacuum apparatus, and 58 represents an exhaust pump.

The surface conduction electron-emitting device, the anode electrode 21 and the like are disposed in the vacuum apparatus 57. The vacuum apparatus 57 is provided with required units, such as a vacuum meter (not shown), so as to be capable of measuring and evaluating the surface conduction electron-emitting device in a desired vacuum state.

The exhaust pump 58 consists of a usual vacuum apparatus system formed by a turbo pump or a rotary pump and ultra vacuum apparatus system comprising an ion pump or the like. The overall body of the vacuum apparatus 57 and the substrate 1 of the electron-emitting device can be heated by a heater (not shown). Note that the measuring and evaluation system can be, as described later, adapted to perform measurement, evaluation and process of the forming process and ensuing process by forming a display panel and its inside portion as the vacuum apparatus 57 and its inside portion in a step of assembling the display panel (refer to 201 shown in FIG. 10).

(4) In the case of the surface conduction electron-emitting device according to the present invention, it is preferable that an activation process is performed for depositing carbon and carbon compound on the region including the electron-emitting portion 2.

As a method of depositing carbon and carbon compound on the region including the electron-emitting portion 2, it is preferable that a method is employed in which voltage pulses are applied between the device electrodes 4 and 5 in a vacuum atmosphere (a degree of vacuum, for example, about $10^{-4}$ to $10^{-5}$ Torr) in which organic substances exist because of easiness. In particular, the foregoing method is able to significantly improve the electron-emitting characteristics in the case of the surface conduction electron-emitting device.

The vacuum atmosphere, which is required in the activation process and in which organic substances exist, can be formed by using organic gas left in the atmosphere in the case where gas in the vacuum container has been exhausted by using, for example, an oil diffusion pump or a rotary pump. Also the vacuum atmosphere can be formed by introducing an appropriate organic substance gas into a vacuum, from which gas has been sufficiently exhausted by an ion pump or the like. The preferred gas pressure of the organic substance varies depending upon the form of the application, the shape of the vacuum container, the type of the organic substance and the like. Therefore, a suitable pressure level is selected. A preferred organic substance is selected from a group consisting of aliphatic hydrocarbon, such as alkane, alkene or alkyne; aromatic hydrocarbon; and organic acid, such as alcohol, aldehyde, ketone, amine, phenol, carvone or sulfonic acid. Specifically, a material may be employed which is selected from a group consisting of saturated hydrocarbon expressed by $C_nH_{2n+2}$, such as methane, ethane or propane; unsaturated hydrocarbon expressed by a composition formula $C_nH_{2n}$, such as ethylene or propylene; benzene, toluene; methanol; ethanol; formaldehyde, acetoaldehyde; acetone; methylethylketone; methylamine; ethylamine; phenol; formic acid; acetic acid; and propionic acid. As a result of the foregoing process, carbon or carbon compound deposits on the device from organic substances existing in the atmosphere so that the device current If and emitted current Ie considerably change.

The carbon and carbon compound are, for example, graphite (including so-called HOPG, PG and GC, where HOPG is graphite having substantially complete crystalline structure, PG is graphite having a crystal size of about 200 Å and slightly disordered crystalline structure and GC is graphite having a crystal size of about 20 Å and further disordered crystalline structure) and amorphous carbon (amorphous carbon and a mixture of amorphous carbon and microcrystal of the foregoing graphite). It is preferable that the thickness of the deposited film is 500 Å or thinner, further preferably 300 Å or thinner.

(5) It is preferable that the thus-manufactured electron-emitting device is subjected to a stabilizing process. The stabilizing process is a process for exhausting organic substances in the vacuum container. It is preferable that the pressure in the vacuum container is $1\times10^{-7}$ Torr or lower, more preferably $1\times10^{-8}$ Torr or lower. It is preferable that a vacuum exhaust apparatus for exhausting gas in the vacuum container is of a type that does not use oil to prevent influence of the oil generated from the apparatus on the characteristic of the device. Specifically, a vacuum exhaust apparatus, such as an adsorption pump or an ion pump, may be employed. When gas in the vacuum container is exhausted, it is preferable that the overall body of the vacuum container is heated to easily exhaust organic substance molecules adhered to the inner surface of the vacuum container and the electron-emitting device. Although the heating conditions in the foregoing case are preferable such that the temperature is 80° C. to 200° C. and the period is 5 hours or longer, the conditions are not limited to the foregoing conditions. The heating process may be performed under conditions appropriately selected to be adaptable to the conditions, such that the size and shape of the vacuum container and the structure of the electron-emitting device.

Although it is preferable that the atmosphere when the foregoing stabilizing process has been completed is maintained when the device is operated, the atmosphere is not limited to this. Sufficient removal of the organic substances will enable sufficiently stable characteristic to be maintained even if the degree of vacuum has been somewhat lowered.

By operating the device in the foregoing vacuum atmosphere, further deposition of carbon or carbon compound can be prevented, thus resulting in that the device current If and the emitted current Ie can be stabilized.

The basic characteristics of the thus-obtained surface conduction electron-emitting device according to the present invention will now be described.

The basic characteristics of the surface conduction electron-emitting device are usually measured in such a manner that the voltage of the anode electrode 21 of the measuring and evaluation system shown in FIG. 6 is set to 1 kV to 10 kV and the distance h from the anode electrode 21 to the surface conduction electron-emitting device is set to be 2 mm to 8 mm.

Figure 7:
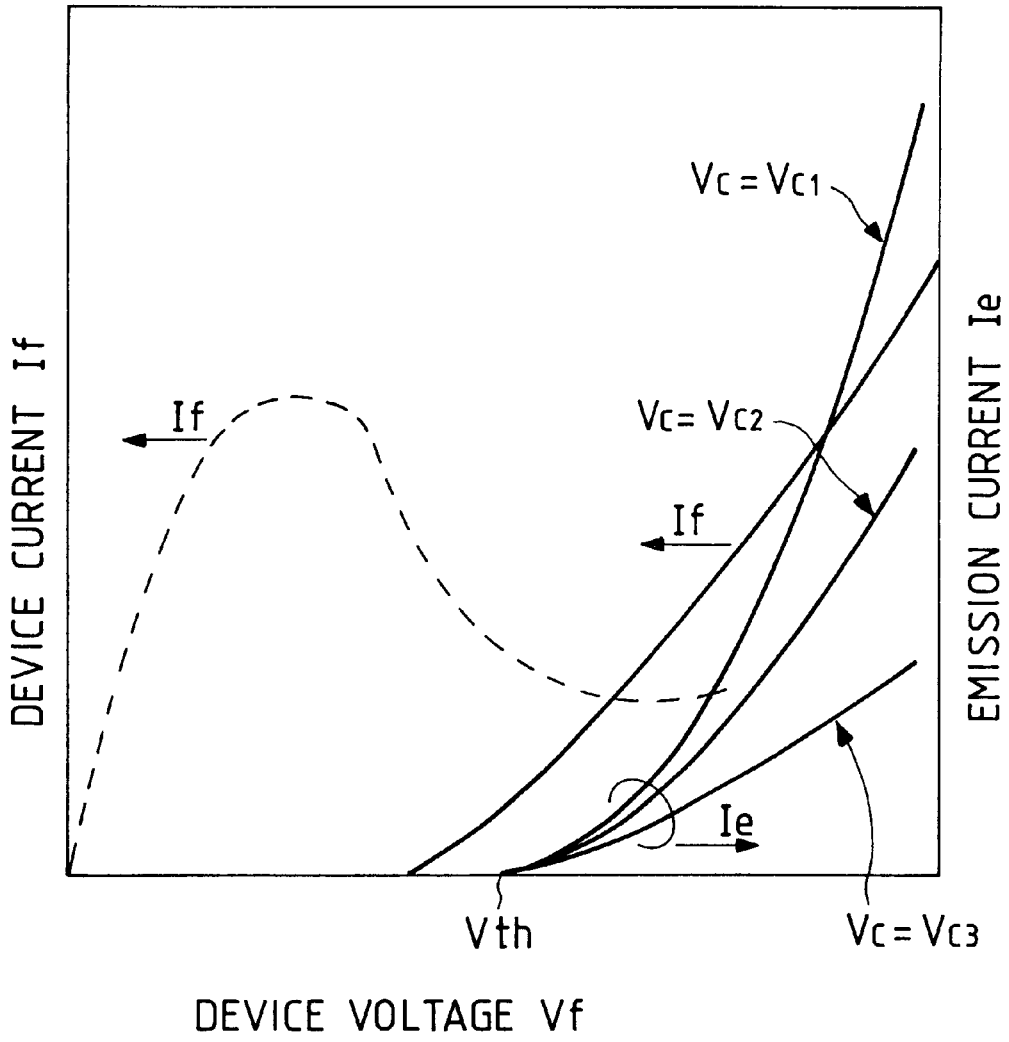
FIG. 7 is a graph showing an emitted current-device voltage characteristic (I–V characteristic) of the surface conduction electron-emitting device according to the present invention.

A typical example of the relationship among the emitted current Ie, the device current If and the device voltage Vf is shown in FIG. 7. Referring to FIG. 7, since the emitted current Ie is considerably smaller than the device current If, it is expressed in arbitrary units. Note that both axis of ordinate and the axis of abscissa stand for linear scales.

As can be understood from FIG. 7, the surface conduction electron-emitting device according to the present invention has three characteristics with respect to the emitted current Ie.

If device voltage Vf, the level of which is higher than a certain level (called a threshold voltage Vth shown in FIG.

7), is applied to the surface conduction electron-emitting device, the emitted current Ie rapidly increases. If the device voltage Vf is lower than the threshold voltage Vth, substantially no emitted current Ie is detected. That is, the surface conduction electron-emitting device according to the present invention is a non-linear device having a clear threshold voltage Vth with respect to emitted current Ie.

Since the emitted current Ie has a monotone increasing characteristic (called an "MI characteristic") with respect to the device voltage Vf, the emitted current Ie can be controlled with the device voltage Vf.

The emitted charge, which is trapped by the anode electrode 21 (see FIG. 6), depends upon the time in which the device voltage Vf is applied. That is, the quantity of the charge, which is trapped by the anode electrode 21, can be controlled with the time in which the device voltage Vf is applied.

Simultaneously with the emitted current Ie having the MI characteristic with respect to the device. voltage Vf, the device current If sometimes has the MI characteristic with respect to the device voltage Vf. An example of the characteristic of the foregoing surface conduction electron-emitting device is indicated by a continuous line shown in FIG. 7. A dashed line shown in FIG. 7 shows a case where the device current If has a VCNR characteristic with respect to the device voltage Vf. The characteristic, which is to be realized, depends upon the method of manufacturing the surface conduction electron-emitting device and the measuring conditions. Even if the surface conduction electron-emitting device is of a type that the device current If has the VCNR characteristic with respect to the device voltage Vf, the emitted current Ie has the MI characteristic with respect to the device voltage Vf.

The emitted current Ie changes with respect to the voltage Vc to be applied to the field correction electrode 7 as shown additionally in FIG. 7. Referring to FIG. 7, since Vc1>Vc2>Vc3, Ie usually monotone-increases with respect to Vc.

Figure 8:
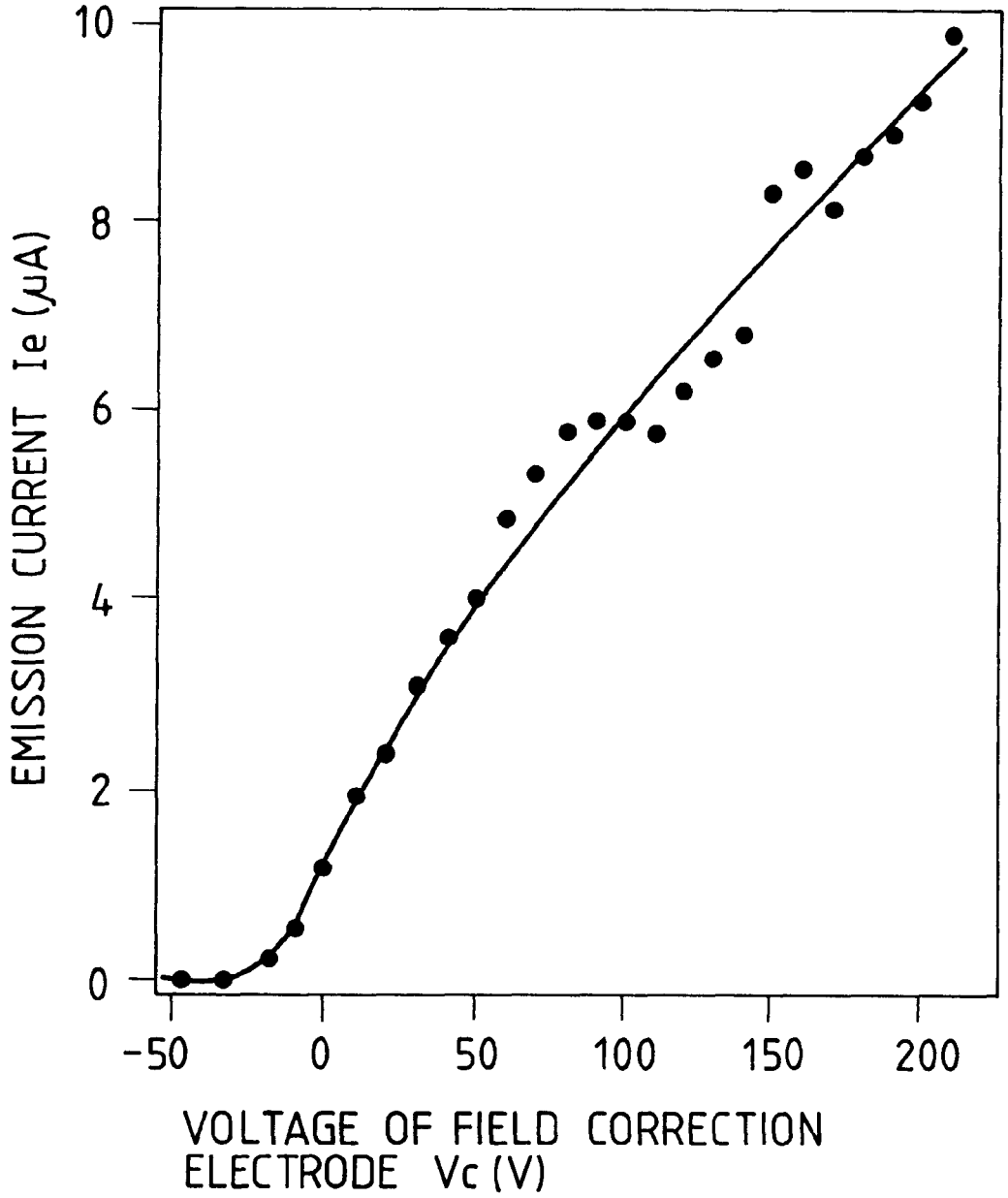
FIG. 8 is a graph showing the relationship between voltages to be applied to the field correction electrode and emission currents realized in the surface conduction electron-emitting device according to the present invention.

The relationship between the emitted current Ie from the electron-emitting device according to the present invention and the voltage Vc to be applied to the field correction electrode 7 is shown in FIG. 8. As can be understood from FIG. 8, the emitted current Ie considerably changes with the correction voltage Vc. The correction voltage Vc is defined by the voltage with respect to the lower potential side device electrode 4. That is, when the correction voltage Vc is 0 V, the realized characteristic substantially coincides with the characteristic of the conventional surface conduction electron-emitting device which has not the field correction electrode 7.

As can be understood from FIG. 8, the emitted current Ie from the electron-emitting device according to the present invention is monotone-increased if the voltage Vc to be applied to the field correction electrode 7 is raised. The foregoing phenomenon is maintained until the correction voltage Vc substantially coincides with the anode voltage Va. In the case shown in FIG. 8, the electron-emitting efficiency can be improved to about 10 times as compared with the conventional surface conduction electron-emitting device if the correction voltage Vc is set to about 200 V.

As can be understood from FIG. 8, the quantity of electrons to be emitted from the electron-emitting device according to the present invention can be decreased by making the correction voltage Vc to be negative with respect to lower potential side device electrode 4. If negative voltage of several V to tens of V is applied, the quantity of electrons to be trapped by the anode electrode can be made to be substantially zero. That is, the quantity of emitted electrons to be trapped by the anode electrode can be switched by changing the correction voltage Vc.

A display apparatus having a fluorescent film on the electron-emitting device according to the present invention will now be described. In the case of the display apparatus according to the present invention in which the fluorescent film is activated and caused to emit light with electron beams, a fact has been known that deterioration of a type called "burning" takes place because a portion of the fluorescent plate is always subjected to intense electron beams due to the intensity distribution of the electron beams. Therefore, the life of the fluorescent plate is determined by the deterioration in the portion, in which the intensity of the electron beams is the strongest.

To elongate the life, the electron beams must be applied uniformly.

In order to achieve the foregoing object, the electron-emitting device according to the present invention is able to shift the position, at which the electron beams are applied to the fluorescent surface, while maintaining the quantity of electrons to be emitted at a constant quantity. Specifically, while preventing shift of the stagnation point during the lapse of time, that is, while maintaining the following parameter shown in FIGS. 6 and 8 at a constant value:

$$\left(Va + \frac{h}{\pi b} Vc\right)$$

the potential (anode potential) Va of a metal back 116 or the illustrated transparent electrode and the potential Vc of the correction electrode are changed to shift the position in the fluorescent plate, at which electrons reach (the fluorescent position) so as to prevent deterioration in the fluorescent plate.

The potential Vc of the field correction electrode and the device voltage Vf may be synchronously changed to make Ie to be constant.

Because of the foregoing characteristics of the electron-emitting device according to the present invention, the quantity of electrons to be emitted can easily be controlled in response to a supplied signal even in an electron source or an image-forming apparatus having a plurality of devices. Thus, application to a variety of industrial fields can be performed.

An example of the electron source according to the present invention will now be described in which a plurality of the surface conduction electron-emitting devices according to the present invention are disposed. Initially, the method of configuration of the surface conduction electron-emitting devices will now be described.

As for the method of configuration of the surface conduction electron-emitting devices in the electron source according to the present invention, as well as the ladder-type configuration described in the Related Background Art, a configuration method may be employed in which n Y-directional wires are, through an interlayer insulating layer, disposed on m X-directional wires, and the X-directional wire and the Y-directional wire are connected to a pair of device electrodes of the surface conduction electron-emitting device. Hereinafter the foregoing configuration is called a "matrix configuration". The matrix configuration will now be described.

The basic characteristics of the surface conduction electron-emitting device enables the emitted electrons in the surface conduction electron-emitting device to be controlled with the wave height and the pulse width of the pulse voltage to be applied between opposite electrodes if the voltage is higher than the threshold voltage. If the voltage is lower than the threshold voltage, substantially no electron is emitted. Therefore, in the case where a multiplicity of the surface conduction electron-emitting devices are disposed, applying of the pulse voltage to each device will enables the surface conduction electron-emitting device to be selected in response to the input signal so as to control the quantity of electrons to be emitted. Thus, only a simple matrix wire is required to select and individually operate each surface conduction electron-emitting device.

The simple matrix configuration is formed on the basis of the foregoing principle. The structure of an electron source having the simple matrix configuration, which is an example of the electron source according to the present invention, will be further described with reference to FIG. 9.

Figure 9:
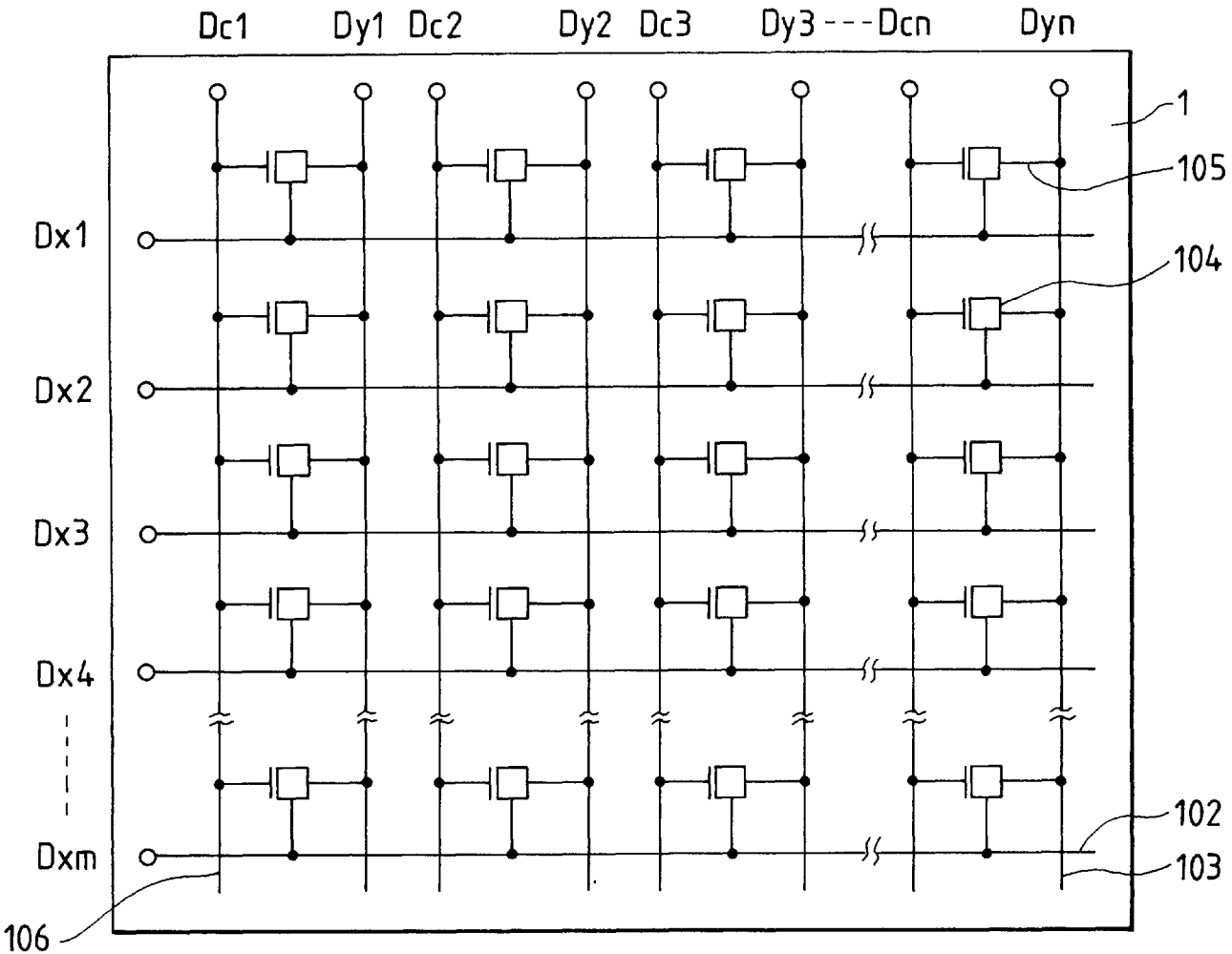
FIG. 9 is a schematic view showing the structure of an electron source in a simple matrix configuration according to the present invention.

Referring to FIG. 9, the substrate 1 is a glass plate as described above, the number and shape of the surface conduction electron-emitting devices according to the present invention to be disposed on the substrate 1 are appropriately determined to meet the purpose.

M X-directional wires 102 respectively have external terminals Dx1, Dx2, . . . , Dxm, the X-directional wires 102 being conductive metal wires formed on the substrate 1 by a vacuum evaporation method, printing method or a sputtering method. To equally apply voltage to the multiplicity of the surface conduction electron-emitting devices 104, the material, thickness and the wire width are appropriately determined.

N Y-directional wires 103 respectively have external terminals Dy1, Dy2, . . . , Dyn, the Y-directional wires 103 being formed similarly to the X-directional wires 102.

N field correction electrode wires 106 respectively have external terminals Dc1, Dc2, . . . , Dcn and are formed similarly to the Y-directional wires 103, the field correction electrode wires 106 being alternately formed in parallel to the Y-directional wires 103.

Among the m X-directional wires 102, n Y-directional wires 103 and the n field correction electrode wires 106, interlayer insulating layers (not shown) are formed so as to electrically insulating the wires so that the matrix wire structure is formed. Note that both symbols m and n are plus integers.

The interlayer insulating layer (not shown) is made of $SiO_2$ or the like and formed by vacuum evaporation method, printing method or the sputtering method. The entire surface of the substrate 1 having the Y-directional wires 103 and the field correction electrode wires 106 are partially formed into a desired shape. To endure the difference in the intersection occurring among the Y-directional wires 103, the field correction electrode wires 106 and the X-directional wires 102, the thickness, material and the manufacturing method are appropriately selected.

Furthermore, the opposite device electrodes (not shown) and field correction electrode (not shown) of the surface conduction electron-emitting device 104 are respectively electrically connected to m X-directional wires 102, n Y-directional wires 103 and n field correction electrode wires 106 by wires 105 made of conductive metal or the like formed by the vacuum evaporation method, the printing method or the sputtering method.

The m X-directional wires 102, n Y-directional wires 103, n field correction electrode wires 106 and the wires 105 may be made of partially or completely the same component elements or made of different elements. The foregoing wires are made of materials appropriately selected from the foregoing materials for the device electrode. The surface conduction electron-emitting device 104 may be formed on the substrate 1 or the interlayer insulating layer (not shown).

As described later, to scan the rows of the surface conduction electron-emitting devices 104 disposed in the X-direction in response to the input signal, a scanning signal applying means (not shown) for supplying the scanning signal is electrically connected to the X-directional wires 102. To scan each row of the surface conduction electron-emitting devices 104 disposed in the Y-direction, a modulation signal generating means (not shown) for supplying a modulation signal is electrically connected to the Y-directional wires 103. The drive voltage to be applied to each of the surface conduction electron-emitting device 104 is supplied as the difference voltage between the scanning signal and the modulation signal to be supplied to the surface conduction electron-emitting device 104.

Figure 10:
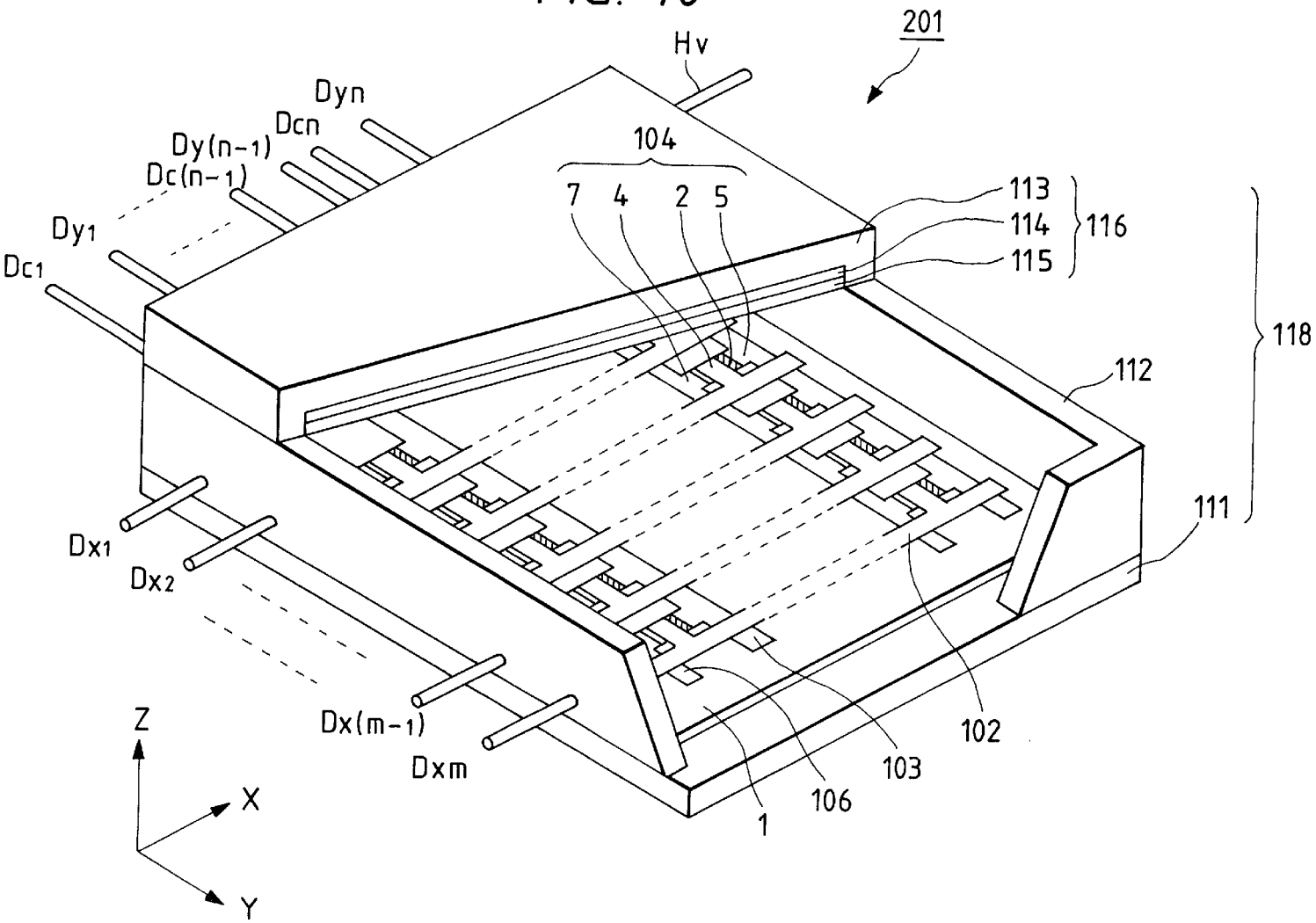
FIG. 10 is a schematic view showing the structure of a display panel for use in an image-forming apparatus according to the present invention which comprises the electron source in the simple matrix configuration.
Figure 11A:
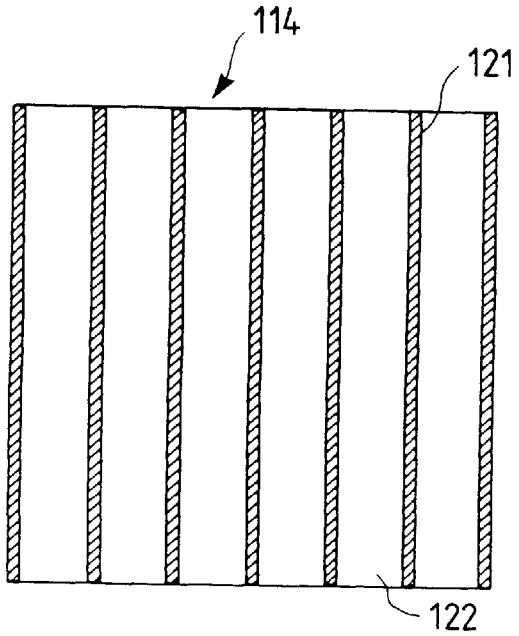
FIGS. 11A and 11B are diagrams showing a fluorescent film of the display panel shown in FIG. 10.
Figure 11B:
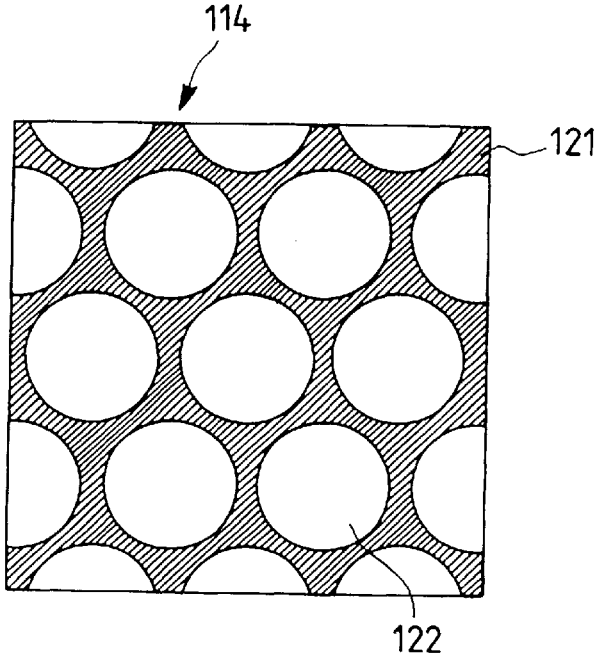
Figure 12:
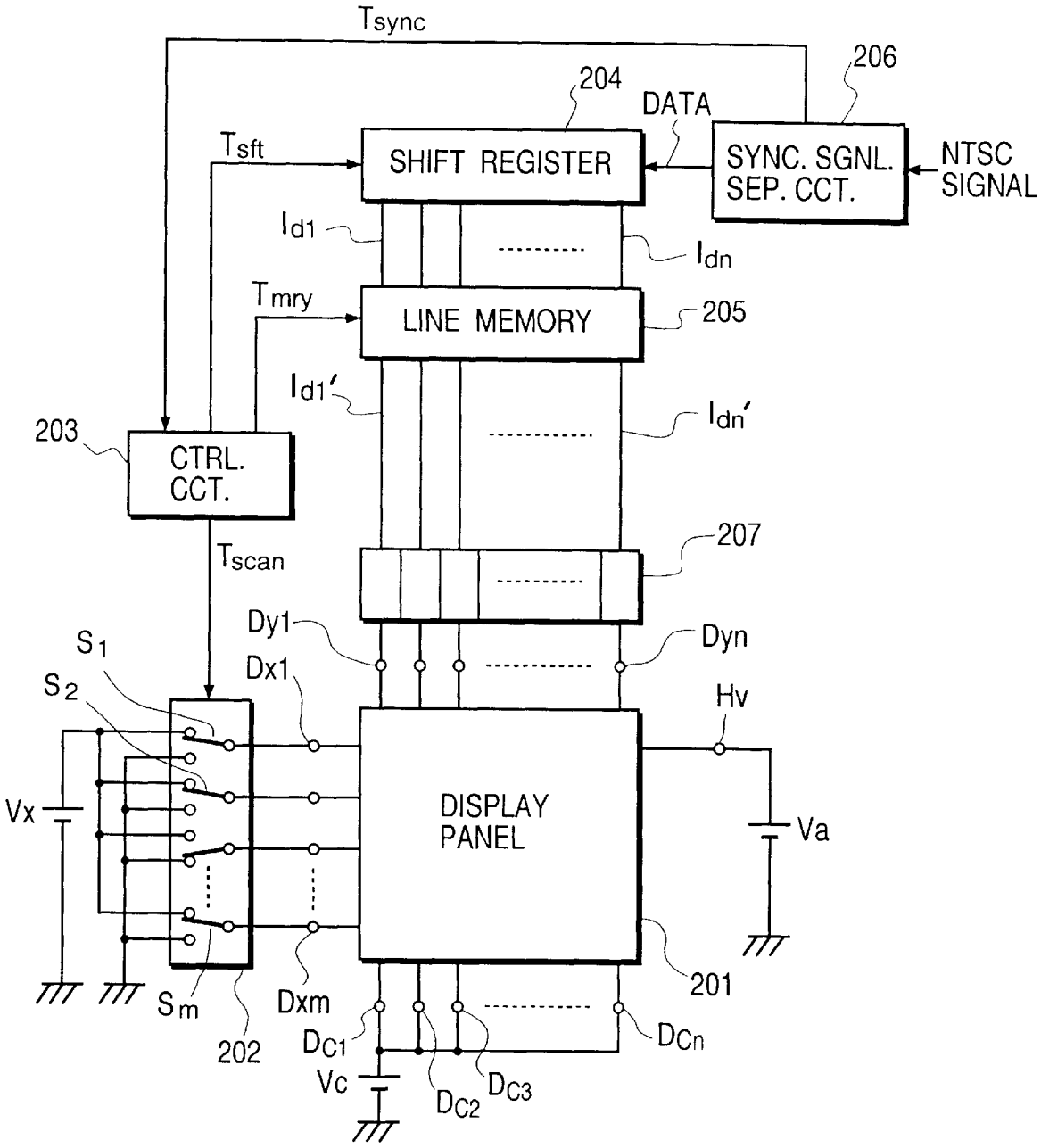
FIG. 12 is a diagram showing an example of a circuit for operating the display panel shown in FIG. 10.

An example of the image-forming apparatus according to the present invention, which is formed by using the foregoing simple matrix configuration electron source, will now be described with reference to FIGS. 10 to 12. FIG. 10 is a diagram showing the basic structure of the display panel 201. FIGS. 11A and 11B are diagrams showing a fluorescent film 114, and FIG. 12 is a block diagram showing an example of a drive circuit for causing the display panel 201 shown in FIG. 10 to perform TV display in response to an NTSC TV signal.

Referring to FIG. 10, reference numeral 1 represents a substrate of the electron source on which the surface conduction electron-emitting devices according to the present invention are disposed as described above, 111 represents a rear plate to which the substrate 1 is secured, 116 represents a face plate on which the fluorescent film 114, a metal back 115 and the like serving as the image-forming members are formed on the internal surface of a glass substrate 113, and 112 represents a support frame. The rear plate 111, the support frame 112 and the face plate 116 form an envelope 118 by applying frit glass or the like to their connection portions and by baking, in nitrogen atmosphere, the foregoing elements at 400° C. to 500° C. for 10 minutes or longer to seal the elements.

Referring to FIG. 10, reference numerals 102 and 103 represent X-directional wires and Y-directional wires connected to the pair of device electrodes 4 and 5 (see FIG. 1) of the surface conduction electron-emitting device 104, each of the X-directional wires 102 and the Y-directional wires 103 respectively having external terminals Dx1 to Dxm and Dy1 to Dyn. Reference numeral 106 represents a wire connected to the field correction electrode of the surface conduction electron-emitting device 104, the wire 106 having external terminals Dc1 to Dcn.

The envelope 118 is, as described above, formed by the face plate 116, support frame 112 and the rear plate 111. Since the rear plate 111 is provided to mainly reinforce the strength of the substrate 1, the rear plate 111 is not required if the substrate 1 has sufficient strength. In the foregoing case, the support frame 112 may be directly sealed to the substrate 1 to form the envelope 118 by the face plate 116, the support frame 112 and the substrate 1. By inserting a support member called a spacer (not shown) between the face plate 116 and the rear plate 111, the envelope 118 is made to be sufficiently strong against the atmospheric pressure.

The fluorescent film 114 is formed by only a fluorescent member 122 in the case of monochrome display. In the case where the fluorescent film 114 is a color fluorescent film, the fluorescent film 114 is composed of black conductive members 121 called a black stripe (see FIG. 11A) or a black matrix (see FIG. 11B) and the fluorescent members 122. The black stripe or the black matrix are provided to blacken the boundary among the fluorescent members 122 for the three primary colors required to display a color image so as to prevent striking of color mixture or the like and to prevent lowering of the contrast due to reflection of external light by the fluorescent film 114. The material of the black conductive member 121 may be a material, the main component of which is black lead which is widely used, or any material if the selected material has conductivity and it is able to prevent light penetration and reflection.

As a method of applying the fluorescent material 122 to the glass plate 113, a precipitation method or a printing method is employed regardless of the display being monochrome or color.

As shown in FIG. 10, the metal back 115 is usually provided for the internal surface of the fluorescent film 114. The reason for providing the metal back 115 is to serve as a mirror surface to reflect a portion of light emitted by the fluorescent member 122 (see FIGS. 11A and 11B) to the face plate 116 so as to improve the brightness, to act as an electrode for applying voltage for accelerating electron beams and to protect the fluorescent member 122 from being damaged due to collision of negative ions generated in the envelope 118. The metal back 115 can be formed by subjecting the surface of the inside of the fluorescent film 114 to a smoothing process (usually called "filming") after the fluorescent film 114 has been formed, and by depositing Al by the vacuum evaporation method or the like.

The face plate 116 may have a transparent electrode (not shown) on the outer surface of the fluorescent film 114 to improve the conductivity of the fluorescent film 114.

When the foregoing sealing process is performed in the case of a color display, the fluorescent members 122 for each color and the surface conduction electron-emitting devices 104 must correspond to one another by satisfactorily aligning their positions.

The internal portion of the envelope 118 is sealed in such a manner that gas therein is, through an exhaust pipe (not shown), exhausted by an exhaust apparatus, such as an ion pump or an absorption pump, that does not use oil, while being appropriately heated similarly to the foregoing stabilizing process, to make the degree of vacuum of the atmosphere to be about $10^{-7}$ Torr in which organic substances are sufficiently decreased. To maintain the degree of vacuum after the envelope 118 has been sealed, a getter process may be performed. The getter process is a process for forming an evaporated film by heating a getter (not shown) disposed at a predetermined position in the envelope 118 by resistance heating, high-frequency heating or the like performed immediately before or after the envelope 118 has been sealed. The getter is usually mainly made of Ba or the like to form the evaporated film which has adsorption effect to maintain the degree of vacuum of, for example, $10^{-7}$ Torr.

Each of the processes for manufacturing the surface conduction electron-emitting device after the forming process has been performed is usually performed immediately before the envelope 118 is sealed in a manner as described above.

The foregoing display panel 201 can be operated by a drive circuit having a structure as shown in, for example, FIG. 12. Referring to FIG. 12, reference numeral 201 represents a display panel, 202 represents a scanning circuit, 203 represents a control circuit, 204 represents a shift register, 205 represents a line memory, 206 represents a synchronizing signal separation circuit, 207 represents a modulation signal generator, and Vx and Va represent DC voltage sources.

As shown in FIG. 12, the display panel 201 is connected to an external electric circuit through the external terminals Dx1 to Dxm, the external terminals Dy1 to Dyn and a high voltage terminal Hv. Scanning signals for sequentially operating one row (each n devices) of the surface conduction electron-emitting device group matrix-disposed in the display panel 201 in a matrix form consisting of m rows and n columns are supplied to the external terminals Dx1 to Dxm.

On the other hand, modulation signals for controlling output electron beams from each surface conduction electron-emitting device for one row selected in response to the foregoing scanning signal are supplied to the external terminals Dy1 to Dyn.

DC voltage is applied to the external terminals Dc1 to Dcn from an external DC voltage source Vc. The DC voltage is usually set to a level higher than the potential to be applied to the higher potential side device electrode of the electron-emitting device to attain an effect of increasing the quantity of electrons which are able to reach the fluorescent members.

DC voltage of, for example, 10 kV, is applied to the high voltage terminal Hv from a DC voltage source Va. The DC voltage is supplied as accelerating voltage for supplying energy sufficient to activate the fluorescent member to electron beams emitted from the surface conduction electron-emitting device.

The scanning circuit 202 includes m switching devices (S1 to Sm schematically shown in FIG. 12). Each of the switching devices S1 to Sm selects either of the output voltage from the DC voltage source Vx or 0 V (ground level) to electrically connect it to the external terminals Dx1 to Dxm of the display panel 201. Each of the switching devices S1 to Sm is operated in response to control signal Ts transmitted from a control circuit 203. In actual, the switching devices S1 to Sm can easily be formed by combining devices, such as FETs, having a switching function.

The DC voltage source Vx according to this embodiment is arranged to output constant voltage in accordance with the characteristics of the foregoing surface conduction electron-emitting device (the threshold voltage) so as to lower the drive voltage to be applied to the surface conduction electron-emitting device, which is not being scanned, than the threshold voltage.

The control circuit 203 synchronizes the respective operations to cause an appropriate display to be performed in response to an image signal supplied from outside. In response to synchronizing signal Tsync supplied from a synchronizing-signal separation circuit 206 to be described later, control signals Tscan, Tsft and Tmry are generated to be supplied to the respective portions.

The synchronizing-signal separation circuit 206 is a circuit for separating, from an NTSC TV signal supplied from outside, a synchronizing signal component and a brightness signal component. The synchronizing-signal separation circuit 206 can easily be formed by using a frequency separation (a filter) circuit, as well known. The synchronizing signal separated by the synchronizing-signal separation circuit 206, as well known, consists of a vertical synchronizing signal and a horizontal synchronizing signal. To simplify the description, the synchronizing signal is expressed as Tsync. On the other hand, the brightness signal of the image separated from the TV signal is expressed as DATA signal for simplifying the description. The DATA signal is supplied to a shift register 204.

The shift register 204 serial/parallel-converts the DATA signals serially supplied in a time sequential manner for each line of the image, the shift register 204 being operated in response to the control signal Tsft supplied from the control circuit 203. The control signal Tsft may be considered to be a shift clock for the shift register 204. Data for one line of the image (corresponding to data for operating n surface conduction electron-emitting devices), which has been serial/parallel converted, is transmitted from the shift register 204 as n parallel signals Id1 to Idn.

The line memory 205 is a storage unit for storing, for a predetermined time, data for one line of the image, the line memory 205 appropriately storing contents of Id1 to Idn in response to the control signal Tmry supplied from the control circuit 203. The stored contents are, as Id'1 to Id'n, supplied to a modulation signal generator 207.

The modulation signal generator 207 is a signal source for appropriately operating and modulating each of the surface conduction electron-emitting devices in accordance with each of image data Id'1 to Id'n. Output signals from the modulation signal generator 207 are, through the terminals Dy1 to Dyn, supplied to the surface conduction electron-emitting devices in the display panel 201.

As described above, the surface conduction electron-emitting device has clear threshold voltage for emitting electrons so that it emits electrons only when voltage higher than the threshold voltage is applied thereto. If voltage higher than the threshold is applied, emitted current changes when the voltage applied to the surface conduction electron-emitting device is changed. If the material, structure and the method for manufacturing the surface conduction electron-emitting device are changed, the degree of change in the emitted current with respect to the threshold voltage or the applied voltage is sometimes changed. In any case, the following fact can be said.

When pulse voltage is applied to the surface conduction electron-emitting device, no electron is emitted if voltage lower than the threshold voltage is applied. If voltage higher than the threshold voltage is applied, electrons are emitted. By changing the wave height of the voltage pulse, the intensity of the electron beams to be emitted can be controlled. By changing the width of the voltage pulse, the total quantity of the charges of the electron beams to be emitted can be controlled.

Accordingly, the surface conduction electron-emitting device can be modulated in response to a supplied signal by a voltage modulation method or a pulse-width modulation method. In the case where the voltage modulation method is employed, the modulation signal generator 207 generates voltage pulses having a predetermined length, the modulation signal generator 207 being formed by a circuit of a voltage modulation type capable of appropriately modulating the wave height of the pulse in accordance with the supplied data. In the case where the pulse-width modulation method is employed, the modulation signal generator 207 generates voltage pulses having a predetermined wave height, the modulation signal generator 207 being formed by a pulse-width modulation circuit capable of appropriately modulating the pulse width.

The shift register 204 and line memory 205 may be of a digital signal type or an analog signal type if each of the selected unit is capable of serial/parallel converting or storing the image signal.

In the case where the digital signal type units are employed, the output signal DATA from the synchronizing-signal separation circuit 206 must be digitized by providing an A/D converter for the output portion of the synchronizing-signal separation circuit 206.

In relation to the foregoing structure, the circuit to be provided for the modulation signal generator 207 is somewhat varied whether the output signal from the line memory 205 is a digital signal or an analog signal.

That is, in the case where the digital signal and voltage modulation method are employed, a known A/D conversion circuit is employed in the modulation signal generator 207; and an amplifying circuit and the like are required to be added, as the need arises. In the case where the digital signal and the pulse-width modulation method are employed, the modulation signal generator 207 can easily be formed by using a circuit formed by combining, for example, a high-speed oscillator, a counter for counting the number of waves transmitted by the oscillator and a comparator for subjecting an output value from the counter and an output value from the foregoing memory. As the need arises, an amplifier may be added which amplifies the voltage of the modulation signal, which has been transmitted from the comparator and the pulse width of which has been modulated, to the level of the voltage for operating the surface conduction electron-emitting device.

In the case where an analog signal and the voltage modulation method are employed, an amplifying circuit comprising a known operational amplifier may be employed as the modulation signal generator 207. As the need arises, a level shift circuit is added. In the case where an analog signal and the pulse-width modulation method are employed, a known voltage control oscillation circuit (VCO) is required. As the need arises, an amplifier may be added which amplifies the voltage to the level of the voltage for operating the surface conduction electron-emitting device.

The image-forming apparatus, according to the present invention and comprising the display panel 201 and the drive circuit, is able to cause its arbitrary surface conduction electron-emitting device to emit electrons when voltage is applied from external terminals Dx1 to Dxm and Dy1 to Dyn. High voltage is applied to the metal back 115 or the transparent electrode (not shown) through the high voltage terminal Hv to accelerate the electron beam, the accelerated electron beam being allowed to collide with the fluorescent film 114 to generate excitation and light emission. Thus, TV display can be performed in response to the NTSC TV signal.

The foregoing structure described schematically is required to obtain the image-forming apparatus according to the present invention. The detailed portions, such as the materials of each element, are not limited to the foregoing description, the detailed portions being allowed to be appropriately selected to satisfy the purpose of the subject image-forming apparatus. Although the NTSC input signal has been described, the image-forming apparatus according to the present invention is not limited to the NTSC signal. Another method, such as PAL or SECAM, may be employed. Another TV signal composed of further large number of scanning lines, for example, high-quality TV method, typified by the MUSE method, may be employed.

Figure 13B:
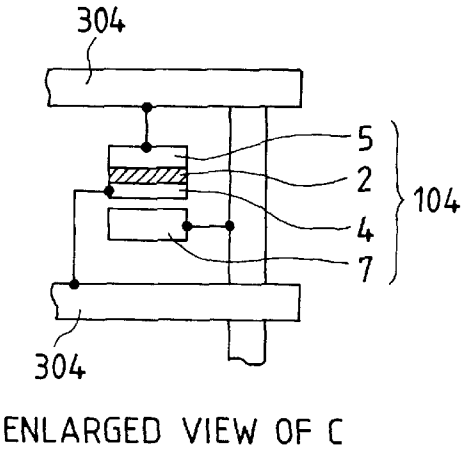
FIGS. 13A and 13B are schematic plan views showing the electron source in the ladder-type configuration according to the present invention.

An example of the foregoing ladder-type electron source and the image-forming apparatus comprising the foregoing electron source according to the present invention will now be described with reference to FIGS. 13A, 13B and 14.

Figure 13A:
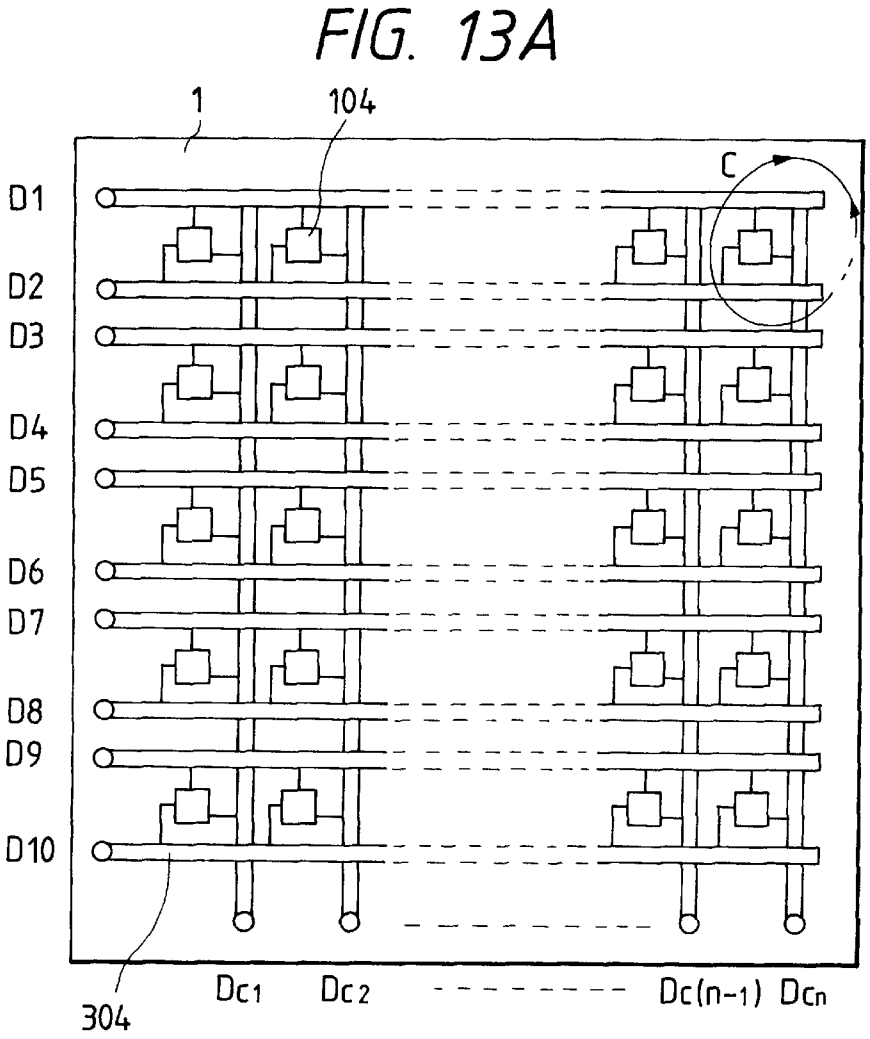

Referring to FIG. 13A, reference numeral 1 represents a substrate, 104 represents a surface conduction electron-emitting device, 304 represents a common wire for connecting the surface conduction electron-emitting devices 104. Ten common wires 304 are provided each of which comprises external terminals D1 to D10.

A plurality of the surface conduction electron-emitting devices 104 are, in parallel, disposed on the substrate 1, the disposed surface conduction electron-emitting devices 104 being called device rows. A plurality of the foregoing rows are disposed so that the electron source is formed.

By applying appropriate drive voltage between the common wires 304 for the respective rows (for example, the common wire 304 for the external terminals D1 and D2), each device row can independently be operated. That is, it is necessary that a device row intended to be caused to emit the electron beam is applied with voltage higher than the threshold voltage, and the device row intended not to be cause to emit the electron beam is applied with voltage lower than the threshold voltage. The foregoing application of drive voltages can be performed by making the adjacent common wires 304 for external terminals D2 to D9, that is, the common wires 304 for the external terminals D2 and D3, D4 and D5, D6 and D7 and D8 and D9 to be the integrated same wire.

Figure 14:
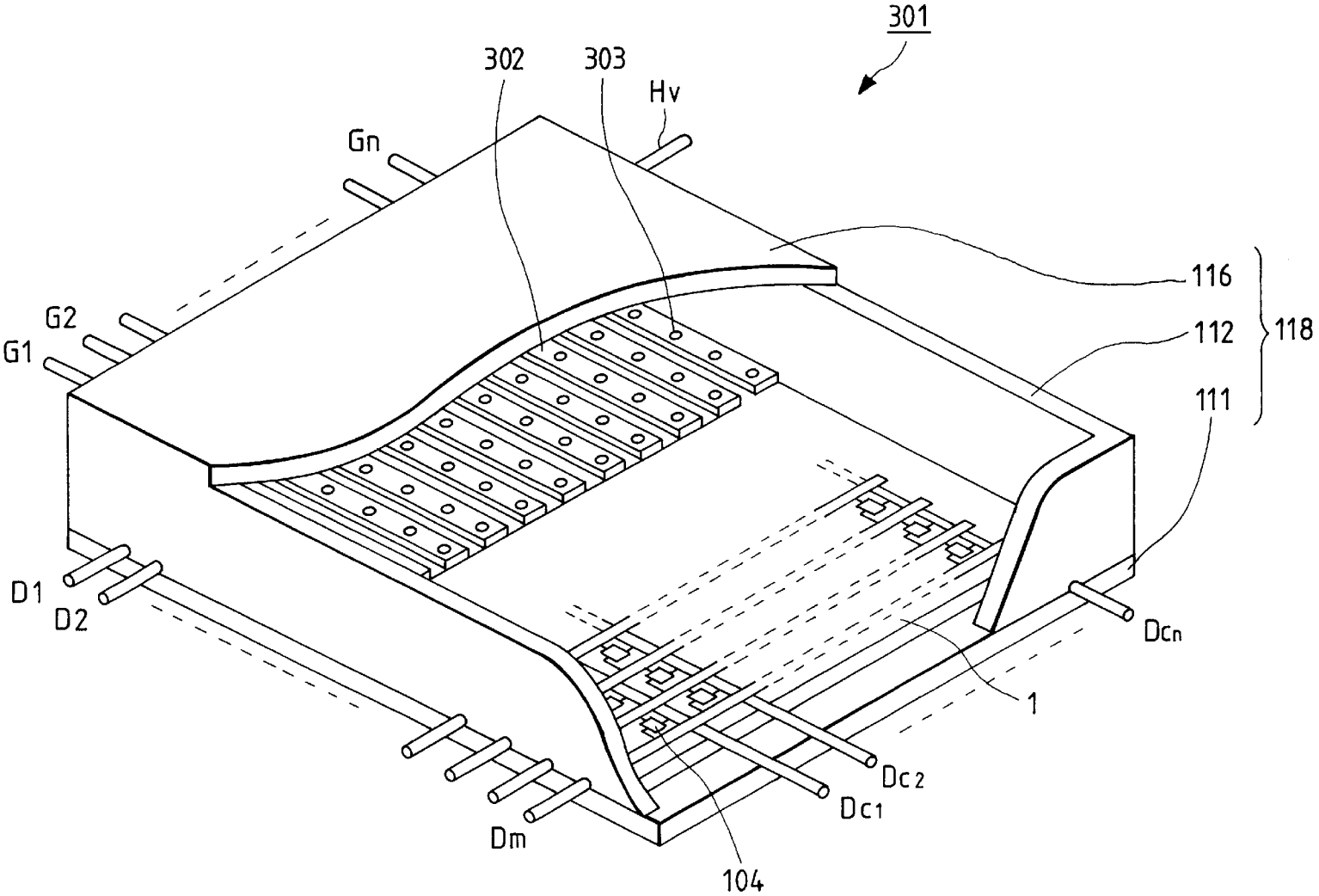
FIG. 14 is a schematic view showing the structure of a display panel for use in an image-forming apparatus according to the present invention which comprises the ladder-type configuration electron source.

FIG. 14 is a diagram showing the structure of a display panel having the ladder-type electron source.

Referring to FIG. 14, reference numeral 302 represents a grid electrode, 303 represents an opening through which electron passes, D1 to Dm represent external terminals for applying voltage to each of the surface conduction electron-emitting devices, G1 to Gn represent terminals connected to the grid electrode 302, and Dc1 to Dcn represent external terminals for applying voltage to the field correction electrode of each of the surface conduction electron-emitting devices. The common wire 304 for each device row is formed as an integrated same wire on the substrate 1.

Referring to FIG. 14, the same reference numerals as those shown in FIG. 10 represent the same elements. A significant difference from the display panel 201 shown in FIG. 10 and comprising the simple matrix configuration is that the grid electrodes 302 are disposed between the substrate 1 and the face plate 116.

Between the substrate 1 and the face plate 116, there are disposed the grid electrodes 302. The grid electrodes 302 are able to modulate the electron beam emitted from the surface conduction electron-emitting device 104, each of the grid electrodes 302 being formed into stripe-like electrode disposed perpendicular to the device row of the ladder-type configuration and having a circular opening 303 to correspond to each surface conduction electron-emitting device 104 to pass through the electron beam.

The shape and configuration of the grid electrodes 302 are not limited to those shown in FIG. 14. For example, a multiplicity of the openings 303 may be formed in a mesh-type configuration. The grid electrodes 302 may be disposed around or adjacent to the surface conduction electron-emitting device 104. The field correction electrode may be used as the grid. That is, the quantity of electrons which are able to reach the anode can be controlled with the voltage Vc to be applied to the field correction electrode, as shown in FIG. 8. That is, since the electron beam to be emitted from the surface conduction electron-emitting device 104 can be modulated, change of the voltage to be applied to the field correction electrode disposed perpendicular to the device rows in the ladder-type configuration enables an image for one line to be displayed by the following method.

The external terminals D1 to Dm and G1 to Gn are connected to a drive circuit (not shown). By applying modulation signals for one line of the image to the lines of the grid electrodes 302 in synchronization with sequential driving (scanning) of the device rows, irradiation of the fluorescent film 114 with each electron beam can be controlled so that an image is displayed for one line.

As described above, the image-forming apparatus according to the present invention is able to employ either of the simple matrix configuration or the ladder-type configuration. Thus, the present invention enables a preferred image-forming apparatus to be obtained to serve as the foregoing display apparatus for the TV broadcasting system and a display apparatus for use in a TV conference system or the computer. Furthermore, the image-forming apparatus according to the present invention can be used as an exposing apparatus for a laser printer comprising a photosensitive drum.

Examples of the present invention will now be described further in detail.

EXAMPLE 1

In this example, the surface conduction electron-emitting device having the structure shown in FIGS. 1A and 1B and according to the present invention was manufactured. By using the surface conduction electron-emitting device, experiments for evaluating the electron-emitting characteristics will now be described. Note that FIG. 1A is a plan view of the device and FIG. 1B is a cross sectional view of the same.

Referring to FIGS. 4A to 4C, a method of manufacturing the surface conduction electron-emitting device according to the present invention will now be described.

Process a

A silicon oxide film having a thickness of 0.5 nm was formed on a cleaned soda lime glass by a sputtering method so that the substrate 1 was manufactured. Then, patterns of the device electrodes 4 and 5 and the field correction electrode 7 were formed on the substrate 1 by photoresist (RD-2000N-41 manufactured by Hitachi Chemical Co., Ltd.). The vacuum evaporation method was performed so that a Ti film having a thickness of 50 Å and a Ni film having thickness of 1000 Å were sequentially deposited. The photoresist patterns were dissolved by organic solvent, and the deposited Ni/Ti films were lifted off so that the device electrodes 4 and 5 and the field correction electrode 7 were formed.

Note that the intervals Gi between the device electrodes was made to be 2 $\mu$m, and the length L1 of the device electrode was made to be 300 $\mu$m. The width W1 of the lower potential side device electrode 4 was made to be 2 $\mu$m, and the spacing G2 was made to be 2 $\mu$m. Furthermore, the field correction electrode 7 having a length of 300 $\mu$m and width W3 of 300 $\mu$m was disposed closely on the outside of the lower potential side device electrode 4.

Process b

Then, a mask having the gap G1 between the device electrodes and opening adjacent to the gap G1 was used, and a Cr film having a thickness of 1000 Å was deposited and patterned by the vacuum evaporation method. Onto the Cr film, organic Pd (ccp4230 manufactured by Okuno Pharmaceuticals) was applied by a spinning coating method by using a spinner, and then heat baking process was performed at 300° C. for 10 minutes. Then, the Cr film was etched by acid etching so that the desired conductive thin film 3 was formed.

The length L2 of the conductive film 3 was made to be 50 $\mu$m. The thickness of the thus-formed conductive thin film 3 mainly composed of palladium oxide was 100 Å and its sheet resistance was $2\times10^4$ Ω/square.

Process c

Then, the substrate 1 having the device electrodes 4 and 5, the field correction electrode 7 and the thin film 3 for forming the electron discharging portion formed thereon was disposed in the vacuum apparatus 57 of the measuring and evaluation system shown in FIG. 6. Then, the exhaust pump 58 was operated so that a degree of vacuum of $2\times10^{-5}$ Torr was realized in the vacuum apparatus 57. Then, the power source 51 for applying the device voltage Vf to the device was activated to apply the voltage between the device electrodes 4 and 5, and the electric current flowing treatment (the forming treatment) was performed so that the electron-emitting portion 2 was formed. The forming treatment was performed by using the voltage waveform shown in FIG. 5B.

In this example, the forming treatment was performed in such a manner that T1 shown in FIG. 5B was set to be 1 ms, T2 shown in the same was set to be 10 ms, a rectangular wave was employed in place of the triangular wave, and weight height of the rectangular wave (the peak voltage in the forming process) was raised by a step of 0.1 V. During the forming treatment, a resistance measuring pulse was simultaneously inserted between T2 with voltage of 0.1 V to measure the device resistance. The forming process was completed when the measured value with the resistance measurement pulse was about 1 MΩ or larger. Simultaneously, application of voltage to the device was completed. As a result, the device according to this example resulted in that the voltage Vf during the forming process was about 5.0 V.

Process d

Then, the device subjected to the forming process was applied with rectangular wave having period T2, pulse width T1 and wave height of 14 V, similar to that in the foregoing process c, so that the activation process was performed for about 30 minutes. Note that the degree of vacuum in the vacuum apparatus 57 was $1.5\times10^{-5}$ Torr at this time.

The thus-manufactured electron-emitting device was called device A. A comparative device was manufactured by the same method as that for manufacturing the device A except the field correction electrode 7 being omitted, the comparative device being called device B.

The electron-emitting characteristics of the device A and device B were measured by continuously using the measuring evaluation system. Note that the measuring conditions were such that the distance h from the anode electrode 21 to the electron-emitting device was 5 mm, the potential of the anode electrode 21 was 5 kV and the degree of vacuum in the vacuum apparatus 57 was $1\times10^{-6}$ Torr.

Device voltage of 16 V was applied between the device electrodes 4 and 5 of each of the devices A and B to measure the device current If and the emitted current Ie flowing at this time. As a result, both device A and the device B resulted in that device current If and emitted current Ie more stable as compared with those measured in the early stage of the measuring process were observed.

Figure 15:
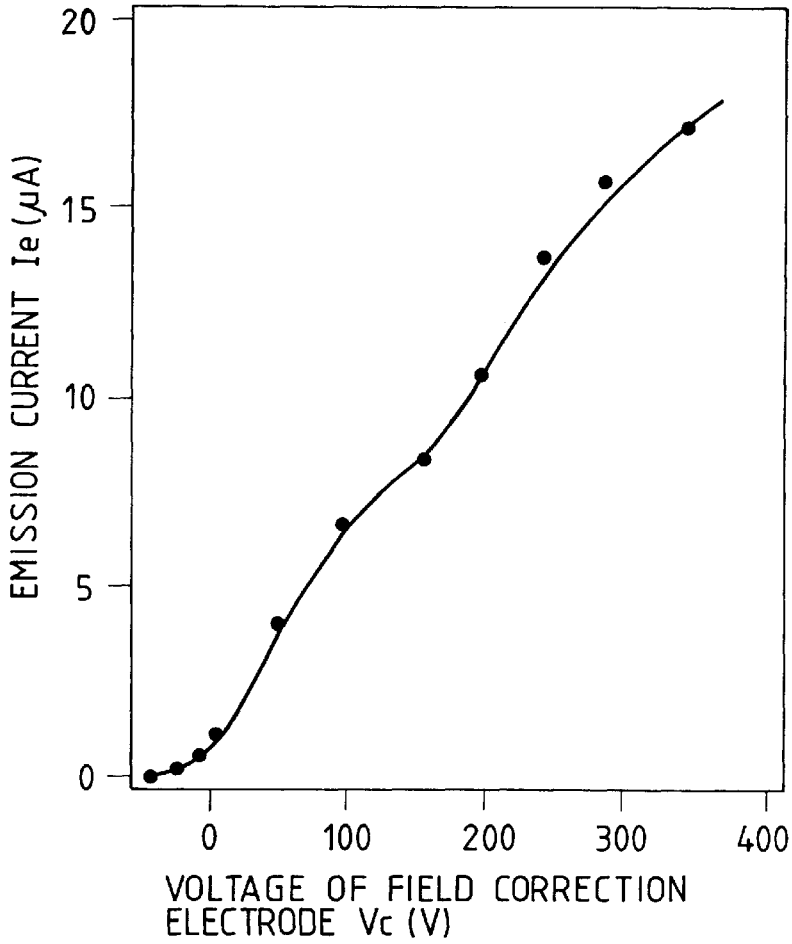
FIG. 15 is a graph showing the characteristic of the electron-emitting device according to Example 1.

While changing the voltage Vc to be applied to the field correction electrode 7 of the device A, the emitted current Ie was measured. As a result, values shown in FIG. 15 were obtained. That is, the electron-emitting efficiency was changed in accordance with the voltage Vc to be applied to the field correction electrode 7 such that the electron-emitting efficiency was in a tendency of monotone increase with respect to the correction voltage Vc. In the range in which the foregoing Equation (3) was satisfied, considerably excellent electron-emitting efficiency was obtained. Specifically, when the correction voltage Vc was 300 V and the device voltage Vf was 16 V, the device current If was 0.8 mA. Thus, the electron-emitting efficiency was about 2.0%.

The comparative device B was resulted in that, when the device voltage Vf was 16 V, the device current If was 0.8 mA and the emitted current Ie was 0.8 μA. Thus, the electron-emitting efficiency was 0.1%.

As a result, the device A according to the present invention exhibited excellent electron-emitting efficiency that was about not more than 20 times that of the conventional device B. That is, it was considered that the device A enabled a portion of electrons, temporarily emitted into the vacuum, to be prevented from being fallen onto the electrode.

EXAMPLE 2

Although Example 1 was arranged such that the field correction electrode 7 was disposed on the same plane on which the device electrodes 4 and 5 were disposed, this example had a structure such that the field correction electrode 7 was formed at a position which is not on the same plane on which the device electrodes 4 and 5 were formed.

Figure 16:
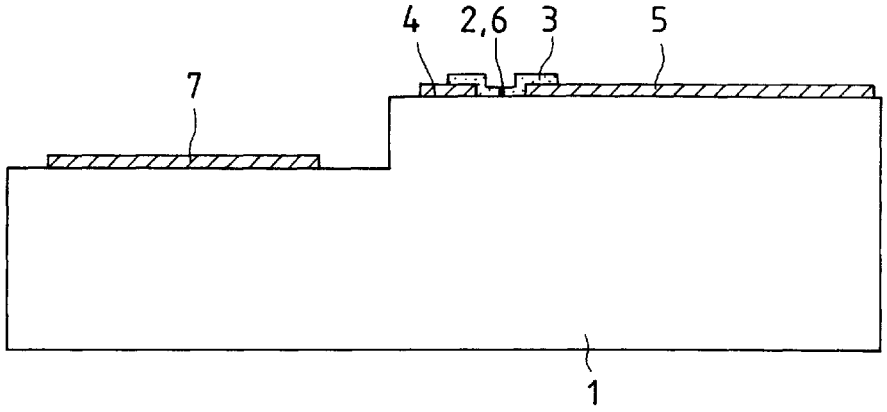
FIG. 16 is a vertical cross sectional view showing an electron-emitting device according to Example 2.

Referring to FIG. 16, the same reference numerals represent the same elements as those shown in FIGS. 1A and 1B. Since manufacturing of the device and the experiment for evaluating the electron-emitting characteristics were performed similarly to Example 1, detailed descriptions are omitted here.

In this example, the width W1 of the lower potential side device electrode 4 was 2 μm, the level difference between the lower potential side device electrode 4 and the field correction electrode 7 was 2 μm, the horizontal directional interval G2 from the lower potential side device electrode 4 to the field correction electrode 7 was 4 μm, and the length L1 of the field correction electrode 7 was 300 μm.

Figure 17:
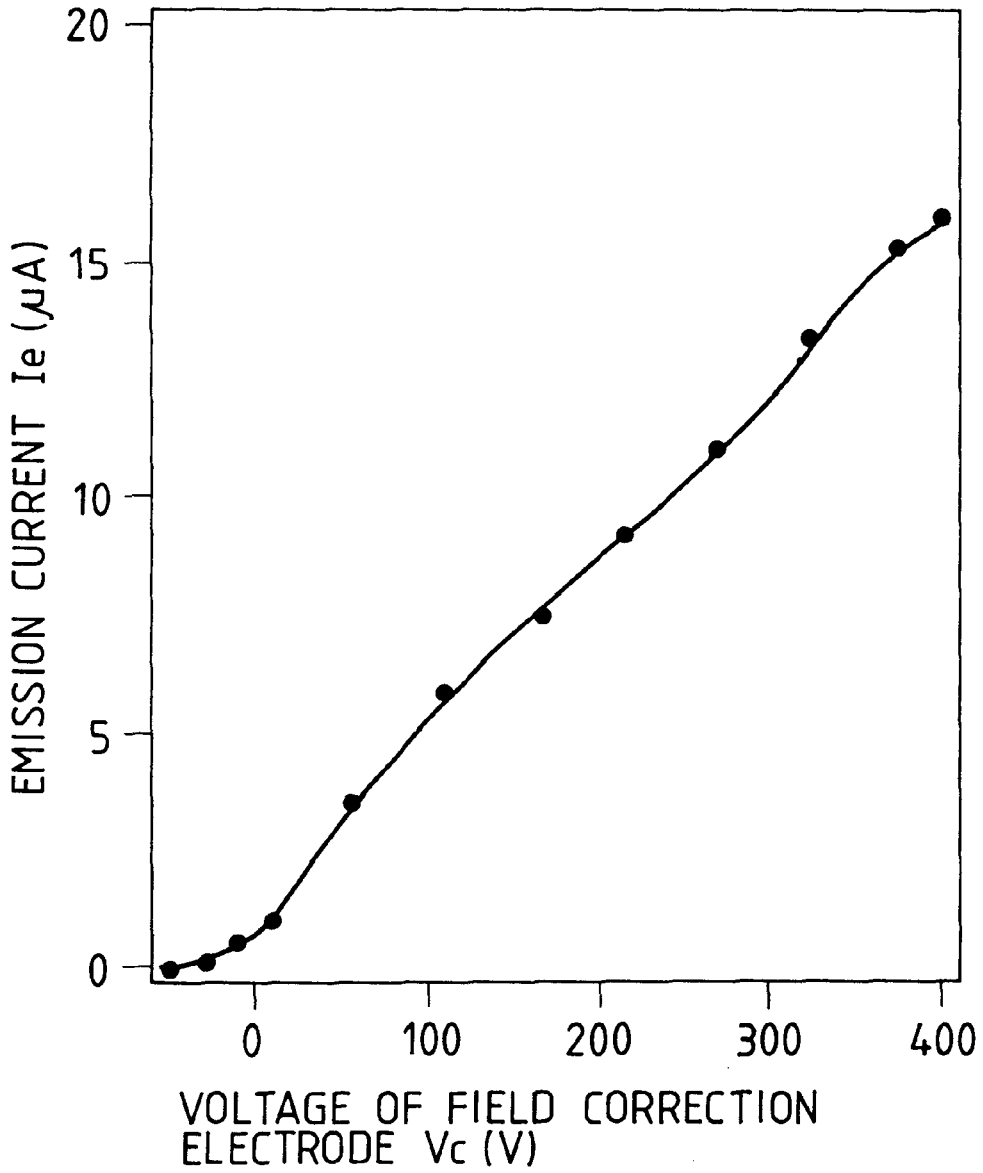
FIG. 17 is a graph showing the characteristic of the electron-emitting device according to Example 2.

Under the same operation conditions as those employed in Example 1, the device according to this example resulted in that the device current If was 0.8 mA and the emitted current Ie was changed as shown in FIG. 17 with respect to voltage Vc to be applied to the field correction electrode 7. The correction voltage Vc must be higher than that required in Example 1 such that when Vc was 300 V, the electron-emitting efficiency was about 1.5%.

EXAMPLE 3

Although Examples 1 and 2 had the structure such that the field correction electrode was disposed adjacent to the higher potential side device electrode, this example had a structure such that the field correction electrode was disposed adjacent to the higher potential side device electrode.

Figure 18A:
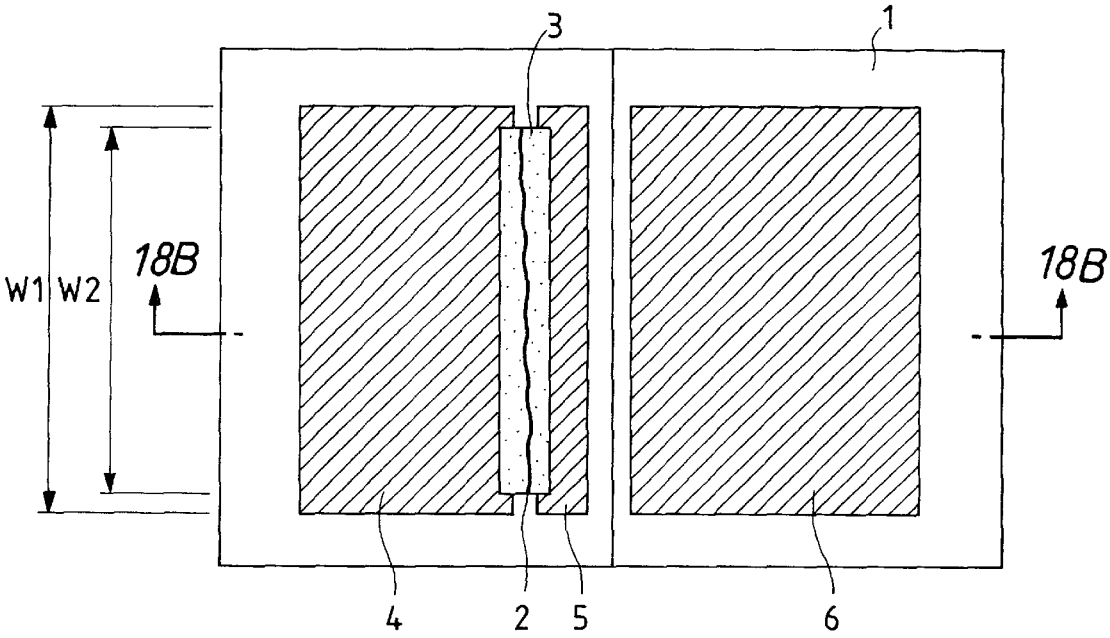
FIGS. 18A and 18B are vertical cross sectional views of an electron-emitting device according to Example 3.
Figure 18B:
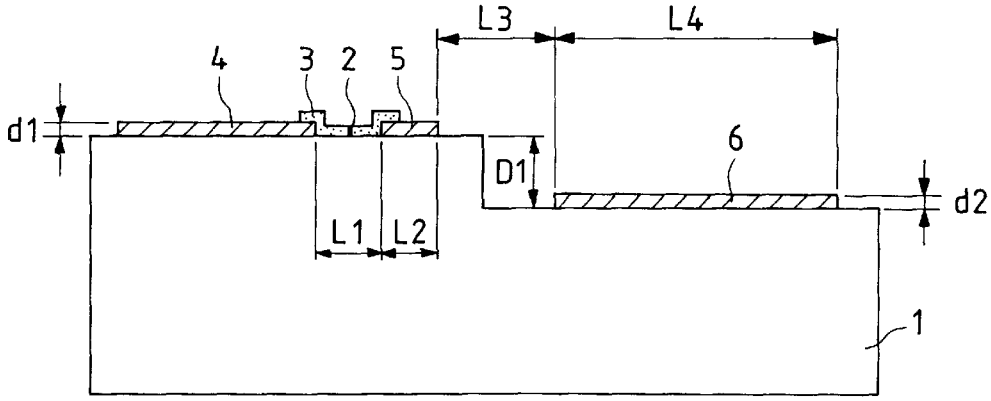

FIG. 18A is a plan view of the device according to this example, and FIG. 18B is a cross sectional view of the same.

Referring to FIGS. 18A and 18B, the same reference numerals represent the same elements as those shown in FIGS. 1A and 1B. Since manufacturing of the device and the experiment for evaluating the electron-emitting characteristics were performed similarly to Examples 1 and 2, detailed descriptions are omitted here.

In this example, the width of the lower potential side device electrode 4 was 2 μm, the level difference between the lower potential side device electrode 4 and the field correction electrode 7 was 2 μm, the horizontal directional interval from the lower potential side device electrode 4 to the field correction electrode 7 was 4 μm, and the width of the field correction electrode 7 was 300 μm.

Figure 19:
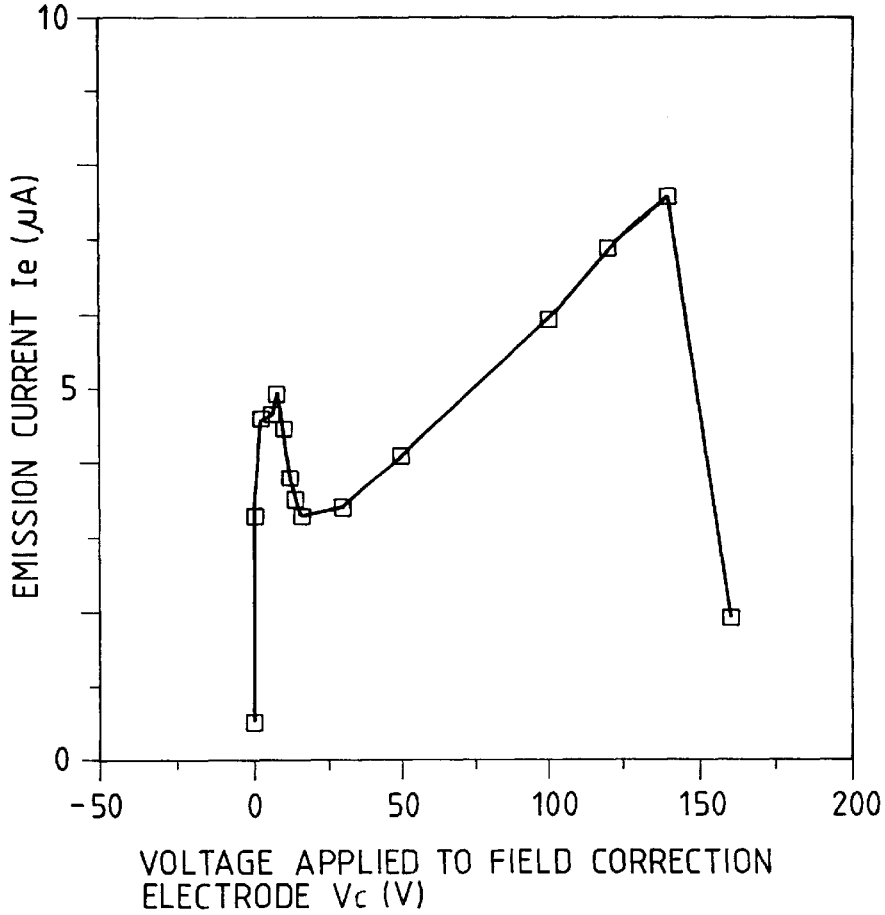
FIG. 19 is a graph showing the characteristic of the electron-emitting device according to Example 3.

Under the same operation conditions as those employed in Example 1, the device according to this example resulted in that the device current If was 0.8 mA and the emitted current Ie was changed as shown in FIG. 19 with respect to voltage Vc to be applied to the field correction electrode 7. The reason why the emitted current Ie had a peak in a region near 10 V was considered that the field correction electrode was disposed at a position lower than the device electrode.

EXAMPLE 4

Figure 20:
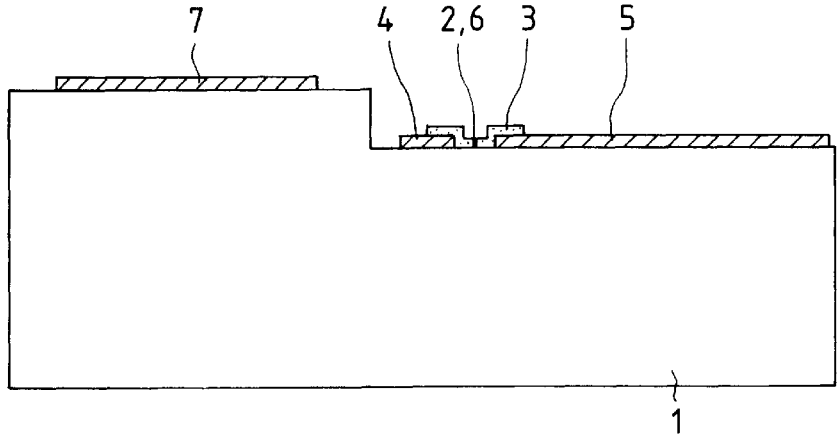
FIG. 20 is a vertical cross sectional view showing an electron-emitting device according to Example 4.

Although Examples 2 and 3 had the structure such that the field correction electrode 7 was formed in a deep portion from the surface of the substrate 1, this example had a structure such that the field correction electrode 7 was formed on the substrate 1 at a position higher than the device electrodes 4 and 5 (a position adjacent to the anode electrode when measurement was performed) as shown in FIG. 20.

Referring to FIG. 20, the same reference numerals represent the same elements as those shown in FIGS. 1A and 1B. Since manufacturing of the device and the experiment for evaluating the electron-emitting characteristics were performed similarly to Example 1, detailed descriptions are omitted here.

In this example, the width of the lower potential side device electrode 4 was 2 μm, the level difference between the lower potential side device electrode 4 and the field correction electrode 7 was 2 μm, the horizontal directional interval from the lower potential side device electrode 4 to the field correction electrode 7 was 4 μm, and the width of the field correction electrode 7 was 300 μm.

Figure 21:
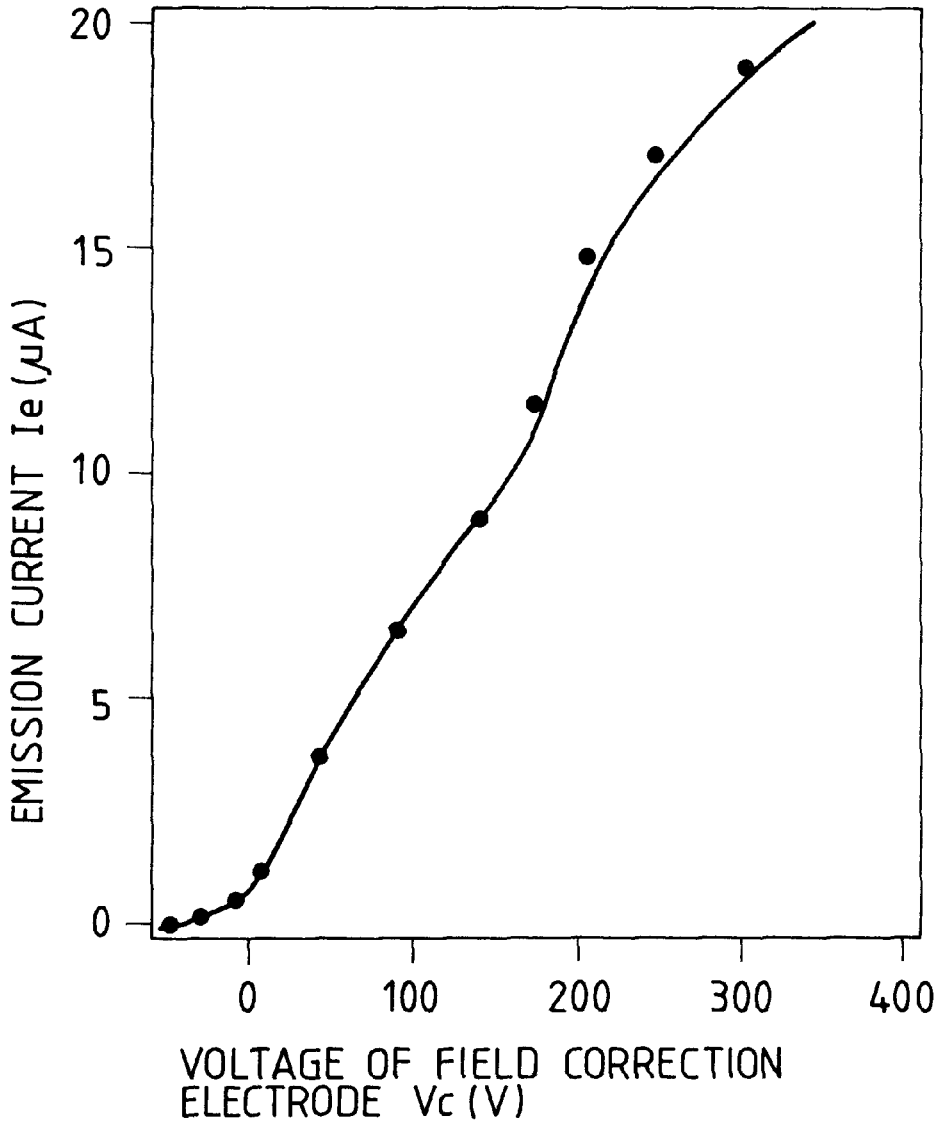
FIG. 21 is a graph showing the characteristic of the electron-emitting device according to Example 4.

Under the same operation conditions as those employed in Example 1, the device according to this example resulted in that the device current If was 0.8 mA and the emitted current Ie was changed as shown in FIG. 21 with respect to voltage Vc to be applied to the field correction electrode 7. The correction voltage Vc was allowed to be lower than those required in Examples 1 and 2 such that when Vc was 300 V, the electron-emitting efficiency was about 2.3%.

EXAMPLE 5

Figure 22:
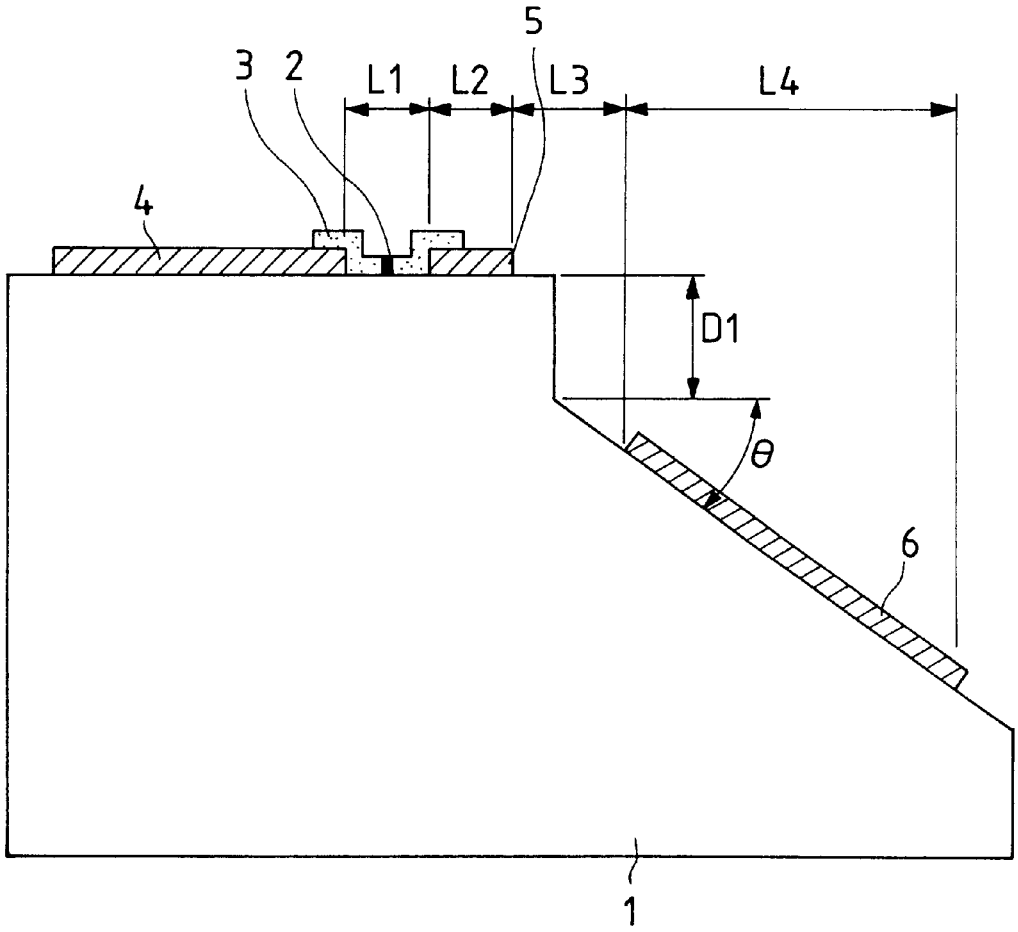
FIG. 22 is a vertical cross sectional view showing an electron-emitting device according to Example 5.

Although Examples 2 and 3 had the structure such that the field correction electrode 6 was formed deep from the surface of the substrate 1 to run parallel to the device electrodes 4 and 5, this example had a structure such that the field correction electrode 6 was formed to be inclined with respect to the device electrodes 4 and 5, as shown in FIG. 22.

In Example 1, if the level of the voltage to be applied to the field correction electrode 6 was raised excessively, all electrons reached the field correction electrode 6 fell onto the field correction electrode 6. The reason for this was that an electric field formed by the voltage applied to the field correction electrode 6 was undesirably made to be larger than the electric field formed above the field correction electrode 6 due to the anode voltage.

Accordingly, this example had a structure as shown in FIG. 22 so as to prevent the foregoing phenomenon and cause electrons to fly farther with the voltage to be applied to the field correction electrode 6.

Referring to FIG. 22, the same reference numerals represent the same elements as those shown in FIGS. 1A and 1B. Since manufacturing of the device and the experiment for evaluating the electron-emitting characteristics were performed similarly to Example 1, detailed descriptions are omitted here.

In the surface conduction electron-emitting device according to this example, the interval L1 between the device electrodes 4 and 5 was 2 μm, the width L2 of the higher potential side device electrode 5 was 2 μm, the interval between the higher potential side device electrode 5 and the field correction electrode 6 was 4 μm, the width L4 of the field correction electrode 6 was 300 μm, the height D1 of the stepped portion was 2 μm, and angle θ of the field correction electrode 6 was 45 degrees.

Figure 23:
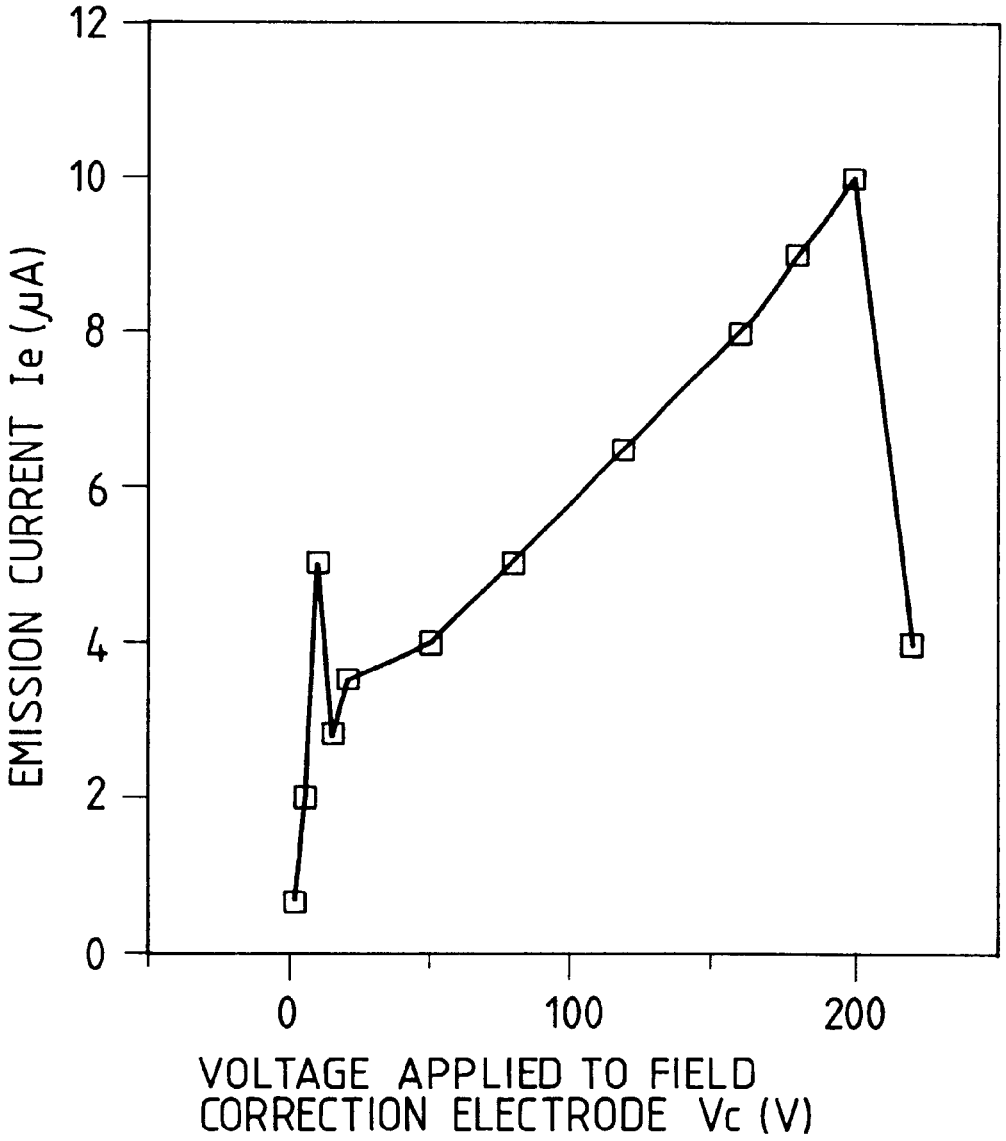
FIG. 23 is graph showing the characteristic of the electron-emitting device according to Example 5.

Under the same operation conditions as those employed in Example 1, the device according to this example resulted in that the device current If was 1.5 mA and the emitted current Ie was changed as shown in FIG. 23 with respect to voltage Vc to be applied to the field correction electrode 6.

This example requires higher voltage Vc to obtain the same efficiency as compared with Examples 1 and 2. When the level of the voltage Vc is low, electrons did not fall onto the field correction electrode 6 but electrons were able to reach the anode electrode 21 (see FIG. 6) so that excellent efficiency points appeared in the form of a peak. If the level of the voltage Vc was high, an excellent electron-emitting efficiency (about 0.67% when Vc was 200 V) was obtained.

EXAMPLE 6

A fact has been known that a display using electron beams encounters a problem that a portion of the fluorescent plate is always exposed to strong electron beams depending upon the intensity distribution of the electron beams and thus deterioration called "burning" sometimes takes place. Therefore, the life of the fluorescent plate is determined by the deterioration in the portion, in which the intensity of the electron beams is the strongest.

To elongate the life, the electron beams must be applied uniformly. An object of this example is to uniformly apply electron beams.

In view of the foregoing, an object of this example is to provide a structure capable of easily correcting the shape of the electron beam and a control method while maintaining a constant efficiency.

Figure 24A:
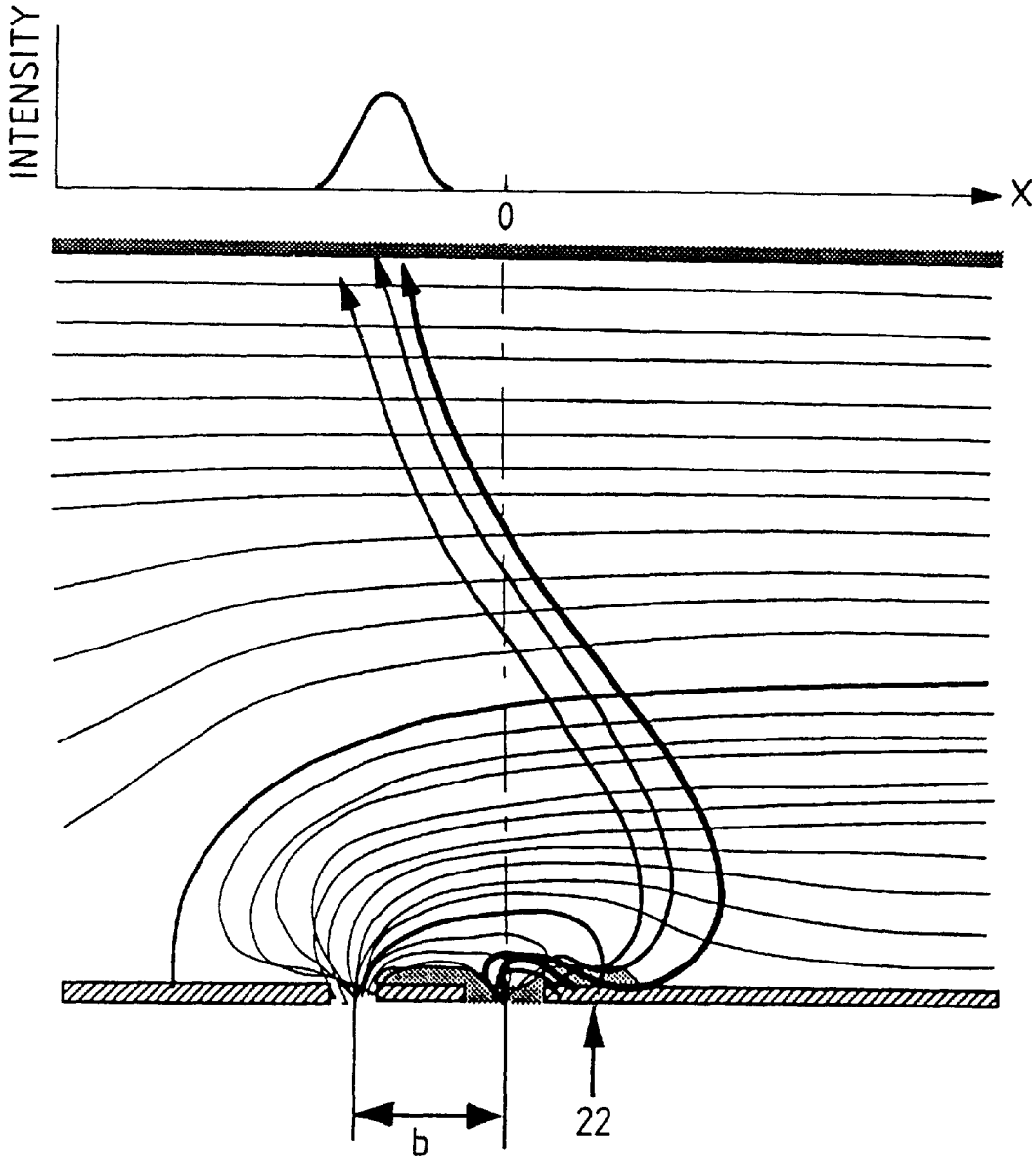
FIGS. 24A and 24B are schematic views of the electric field distribution and electron orbits in an electron-emitting device according to Example 6.
Figure 24B:
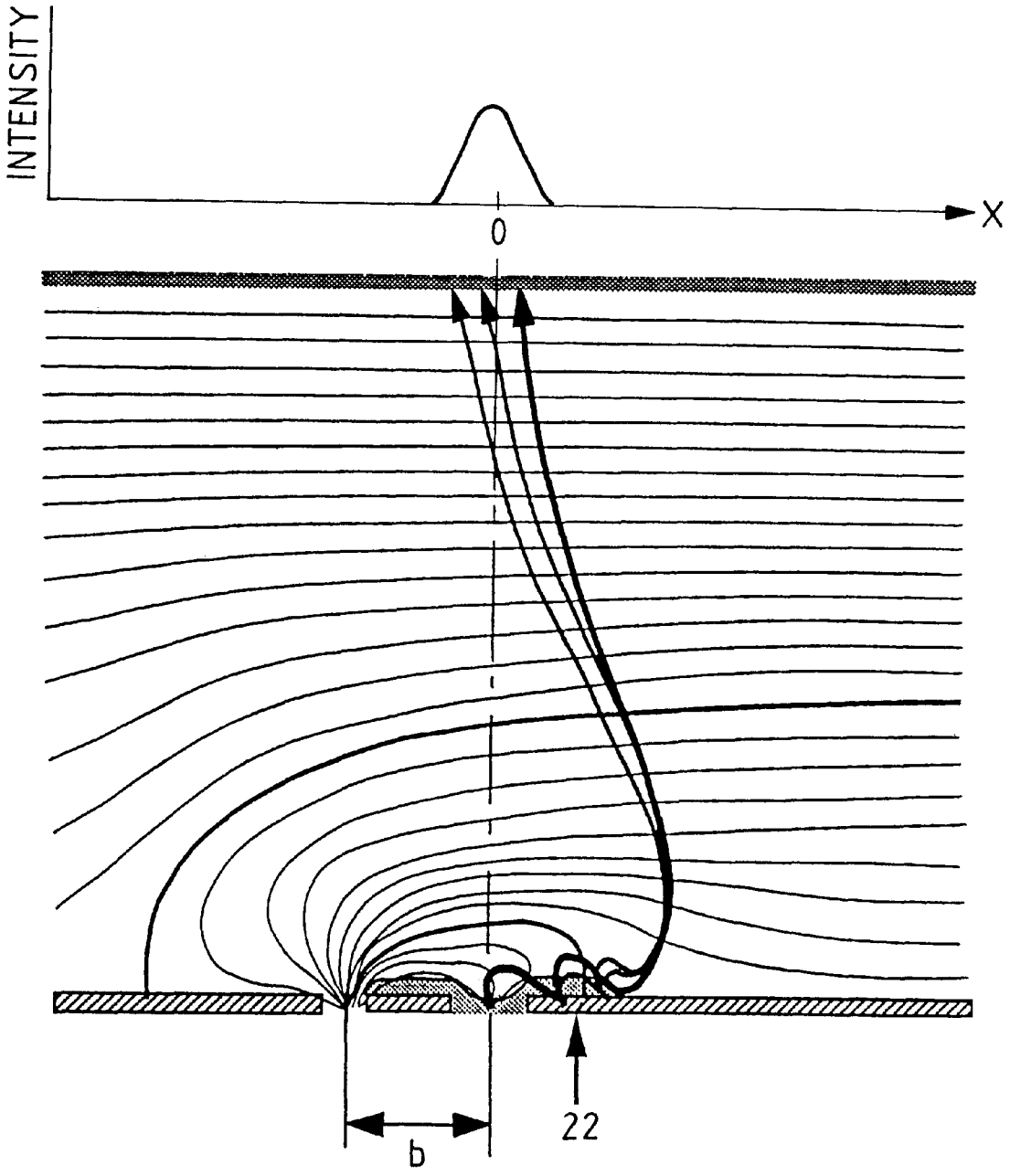

The structure of an electron-emitting device according to this example was the same as that according to Example 1. FIGS. 24A and 24B are schematic views showing potential distribution (continuous lines) and orbits of electrons (arrows) when the voltage to be applied to the field correction electrode and the anode voltage were simultaneously changed and control was performed in such a manner that the singular point (point designated by upward arrows) of the electric field was constant.

Since $h/\pi b=5\times10^{-3}[m]/(3.14\times4\times10^{-6})[m]=400$, the example was arranged in such a manner that the potential of the correction electrode was changed from 25 V to 30 V and the anode potential was changed from 2 KV to 4 KV as the time passed to make Va+400 Vc to be constant, specifically make Va+400 Vc to be 14000 V. Although the electron emission efficiency was not changed after the foregoing potentials had been changed, positions at which electrons reached were changed as indicated by the intensity distribution shown in the upper portions of FIGS. 24A and 24B. The foregoing operation to be performed as the time passes when the fluorescent member is placed on the anode plate enables deterioration in the fluorescent member to be prevented without change in the brightness.

EXAMPLE 7

Example 7 had a structure in which an electron source as shown in FIG. 9 and formed by a multiplicity of the surface conduction electron-emitting devices according to the present invention disposed in a simple matrix configuration was used to manufacture an image-forming apparatus as shown in FIG. 10.

Figure 25:
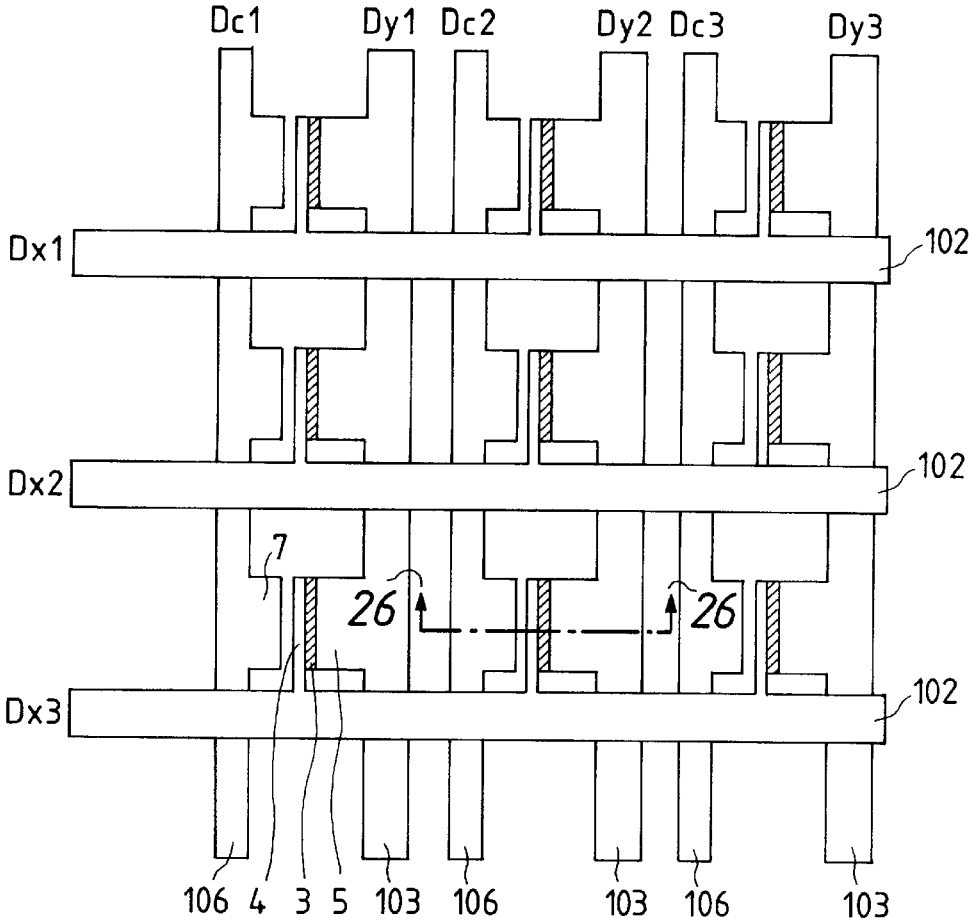
FIG. 25 is a partial plan view showing the simple matrix configuration electron source according to Example 4.
Figure 26:
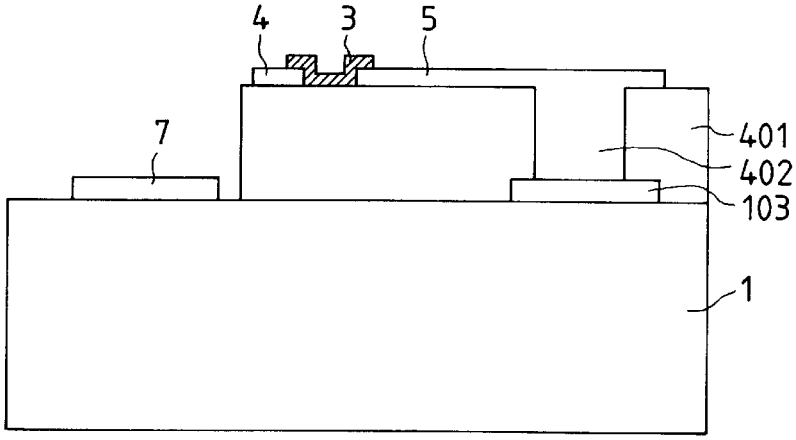
FIG. 26 is a partial cross sectional view of the electron source shown in FIG. 20.

FIG. 25 is a plan view of a portion of the substrate 1 in which a plurality of conductive films are matrix-wired. A cross section taken along line 26—26 of FIG. 25 is shown in FIG. 26. Referring to FIGS. 9, 10, 25 and 26, the same reference numerals represent the same elements.

Reference numeral 1 represents a substrate, 102 represents an X-directional wire (as well as called an "upper wire"), 103 represents a Y-directional wire (as well as called a "lower wire"), 106 represents a field correction electrode wire, 3 represents a conductive film, 4 represents a lower potential side device electrode, 5 represents a higher potential side device electrode, 401 represents an interlayer insulating layer, 402 represents a contact hole for establishing electrical connection between the higher potential side device electrode 5 and the lower wire 103.

Initially, a method of manufacturing the electron source according to this example will now be described sequentially.

Process a

A silicon oxide film having a thickness of 0.5 $\mu$m was formed on a sufficiently cleaned soda lime glass by a sputtering method so that the substrate 1 was manufactured. Then, a Cr film having a thickness of 5 nm and an Au film having a thickness of 600 nm were, by the vacuum evaporation method, sequentially stacked on the substrate 1. Then, photoresist (AZ1370 manufactured by Hoechst) was rotary-applied by a spinner, and then baking was performed. Then, the photomask image was exposed to light and developed so that the resist pattern for the lower wires 103, the field correction electrode 7 and its wire 106 was formed. Then, a deposited Au/Cr film was wet-etched so that the lower wires 103, the field correction electrode 7 and the wires 106 each having a desired shape were formed.

Process b

Then, an interlayer insulating layer 401 formed by a silicon oxide film having a thickness of 1.0 $\mu$m was deposited by an RF sputtering method.

Process c

A photoresist pattern for forming the contact hole 402 in the silicon oxide film deposited during process b was manufactured, and the photoresist pattern was used as a mask for use in etching the interlayer insulating layer 401 so that the contact hole 402 was formed. Furthermore, the silicon oxide film on the field correction electrode 7 was removed. Etching was performed by the RIE (Reactive Ion Etching) method using $CF_4$ gas and $H_2$ gas.

Process d

Then, the pattern of the device electrode was manufactured by photoresist (RD-2000N-41 manufactured by Hitachi Chemical Co., Ltd.), and the vacuum evaporation method was employed to sequentially deposit a Ti film having a thickness of 5 nm and a Ni film having a thickness of 100 nm. The photoresist pattern was dissolved by organic solvent, and the deposited Ni/Ti film was lifted off so that the device electrodes 4 and 5 were formed. Note that the shape of the gap between the device electrodes was similar to that according to Example 2.

Process e

A photoresist pattern of the upper wire 102 was formed on the device electrodes 4 and 5, and then a Ti film having a thickness of 5 nm and an Au film having a thickness of 500 nm were sequentially deposited by the vacuum evaporation method. Unnecessary portions were removed by lifting off so that the upper wire 102 having a desired shape was formed.

Process f

To form a thin film for forming the electron-emitting portion, a mask having the gap between the device electrodes and opening adjacent to the gap was used, and a Cr film having a thickness of 1000 Å was deposited and patterned by the vacuum evaporation method. Onto the Cr film, organic Pd (ccp4230 manufactured by Okuno Pharmaceuticals) was applied by a spinning coating method by using a spinner, and then heat baking process was performed at 300° C. for 10 minutes. The thickness of the thus-formed thin film 3 for forming electron-emitting portion mainly composed of palladium oxide was about 100 Å and its sheet resistance was $5\times10^4$ Ω/square.

Process g

The thin film 3 for forming the electron-emitting portion on which the Cr film had been formed and which had been subjected to the baking process was etched by an acidic etchant so that a desired pattern was formed.

Process h

A resist was applied to a portion except the portion of the contact hole 402 so that a pattern was formed. Then, the vacuum evaporation method was employed so that a Ti film having a thickness of 5 nm and an Au film having a thickness of 500 nm were sequentially deposited. Unnecessary portions were removed by lifting off so that the contact hole 402 was embedded.

As a result of the foregoing process, on the insulating substrate 1, there were formed the field correction electrode 7, the wire 106, the lower wire 103, the interlayer insulating layer 401, the upper wire 102, the device electrodes 4 and 5 and the thin film 3 for forming the electron-emitting portion so that an electron source which has not been subjected to forming was obtained.

Then, the thus-manufactured substrate 1 (see FIG. 20), on which the plurality of the conductive thin films 3 were matrix-wired, was used so that an image-forming apparatus was manufactured. The manufacturing procedure will now be described with reference to FIGS. 10 and 11A.

Initially, the substrate 1 (see FIG. 25), on which the plurality of the conductive thin films 3 were matrix-wired, was secured on the rear plate 111. Then, the face plate 116 (formed by forming the fluorescent film 114 and the metal back 115 on the internal surface of the glass plate 113) was disposed above the substrate 1 by a height of 5 mm through the support frame 112. Then, frit glass was applied to connection portions among the face plate 116, the support frame 112 and the rear plate 111, followed by performing baking at 430° C. for 10 minutes or longer so that sealing was performed. The substrate 1 was secured to the rear plate 111 by frit glass.

The fluorescent film 114 serving as the image-forming members was a fluorescent member in a stripe form (see FIG. 11A) to realize color display. Initially, a black stripe was formed, and the fluorescent member 122 for each color was applied by the slurry method so that the fluorescent film 114 was manufactured. The black stripe was made of a material, the main component of which was black lead that was a widely used material.

The metal back 115 was provided on the internal surface of the fluorescent film 114. The metal back 115 was manufactured such that, after the fluorescent film 114 had been formed, the internal surface of the fluorescent film 114 was subjected to a smoothing process (usually called "filming"), and then Al was vacuum-evaporated.

The face plate 116 is sometimes provided with a transparent electrode on the outside of the fluorescent film 114 to improve conductivity of the fluorescent film 114. However, since satisfactory conductivity was obtained by only the metal back 115, the transparent electrode was omitted in this example.

When the foregoing sealing process was performed in the case of a color display, the fluorescent members 122 for each color and the surface conduction electron-emitting devices 104 must correspond to one another by satisfactorily aligning their positions.

The internal portion of the envelope 118 was exhausted to a degree of vacuum of about $10^{-6}$ Torr through an exhaust pipe (not shown) by a vacuum pump. Then, the external terminals Dx1 to Dxm and Dy1 to Dyn were connected to one another, and voltage was applied between the device electrodes 4 and 5 of the surface conduction electron-emitting device 104. Then, the foregoing forming process was performed so that the electron-emitting portion 2 was formed.

The forming process was performed by the voltage waveform shown in FIG. 5B (however, the rectangular wave was employed in place of the triangular wave). In this example, T1 was 1 ms and T2 was 10 ms.

The thus-formed electron-emitting portion 2 was in a state where fine particles, the main component of which was palladium element, were dispersed and disposed, each fine particle having a mean particle size of 30 Å.

Then, rectangular wave (wave height was 14 V) having the same T1 and T2 which were the same as those employed in the forming process was used, and acetone of $10^{-3}$ Torr was introduced so that an activation process was performed while measuring the device current If and the emitted current emitted current Ie.

Then, the internal portion of the envelope 118 was exhausted to a degree of vacuum of about $10^{-7}$ Torr through an exhaust pipe (not shown), and then the exhaust pipe was heated by a gas burner so that welding was performed so as to seal the envelope 118. To maintain the degree of vacuum after sealing had been performed, high-frequency heating method was employed to perform a getter process, the main component of the getter being Ba or the like.

In the thus-manufactured display panel 201 (see FIG. 10), the external terminals Dx1 to Dxm and Dy1 to Dyn of the container were connected to one another, and scanning signals and modulation signals were applied to the respective surface conduction electron-emitting devices 104 from a signal generating means (not shown) so that electrons were emitted. While applying constant voltage through the external terminals Dc1 to Dcn of the container, a high level voltage of several kV or higher was applied to the metal back 114 through the high voltage terminal Hv so that the electron beam was accelerated so as to be collided with the fluorescent film 115. Thus, excitation and light emission were caused to take place so that an image was displayed.

In this example, the quantity of electrons to be emitted from each electron-emitting device was controlled by operating each electron-emitting device by means of the simple matrix. As described above, the quantity of electrons to be emitted from the electron-emitting device according to the present invention can be changed by changing the voltage Vc to be applied to the field correction electrode. Therefore, matrix-type wiring of the field correction electrode of each electron-emitting device to control the voltage Vc so that the quantity of electrons to be emitted from each electron-emitting device is controlled.

EXAMPLE 8

Figure 27:
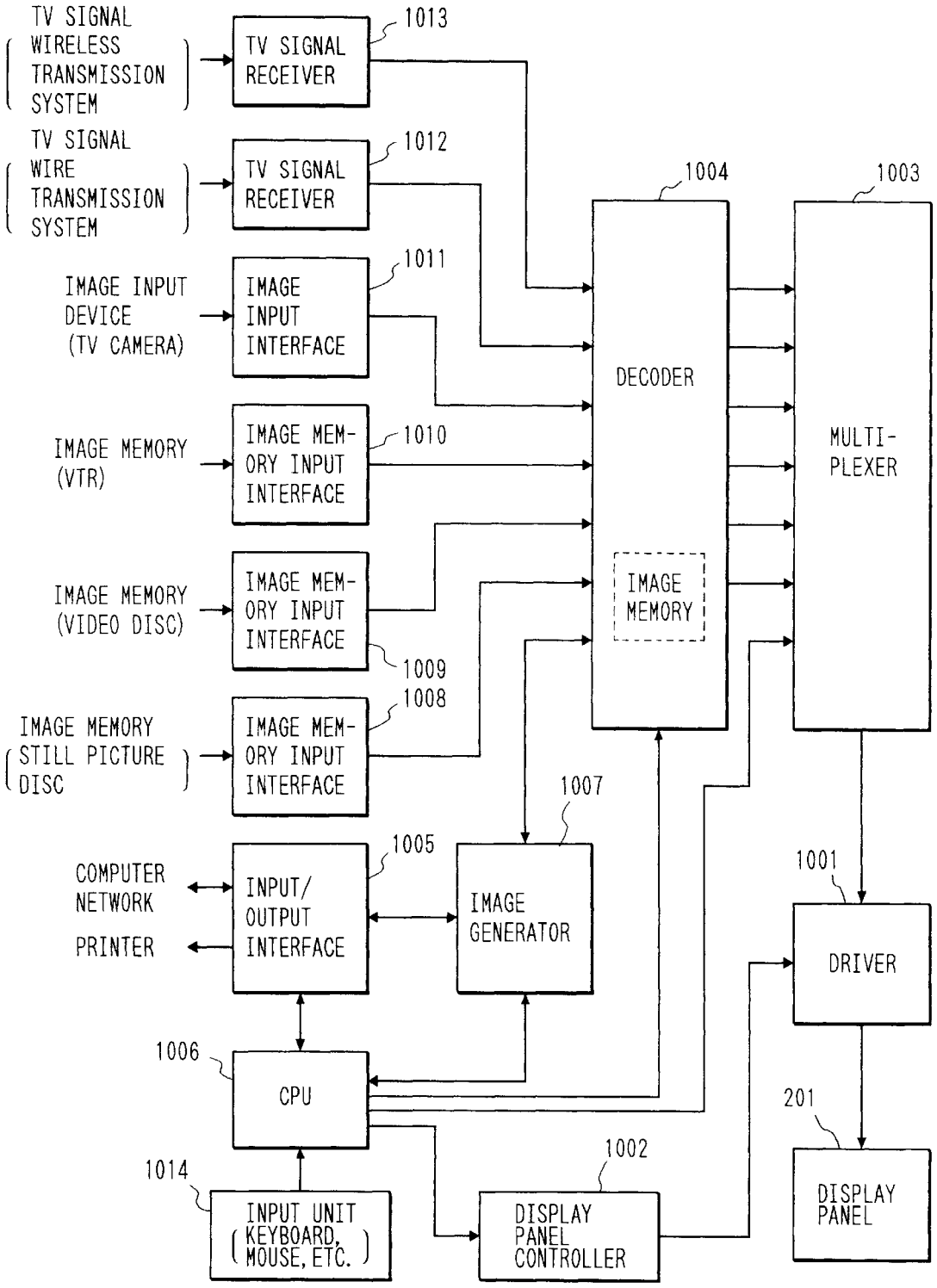
FIG. 27 is a block diagram showing the image-forming apparatus according to Example 5.

FIG. 27 is a diagram showing an image-forming apparatus according to the present invention in which a display panel using the foregoing surface conduction electron-emitting device as the electron source thereof is enabled to display image information supplied from any of a variety of image information sources, typified by TV broadcast.

Referring to FIG. 27, reference numeral 201 represents a display panel, 1001 represents a circuit for operating the display panel 201, 1002 represents a display controller, 1003 represents a multiplexer, 1004 represents a decoder, 1005 represents an input/output interface circuit, 1006 represents a CPU, 1007 represents an image generating circuit, 1008, 1009 and 1010 represent image memory interface circuit, 1011 represents an image input interface circuit, 1012 and 1013 represent TV signal receiving circuit, and 1014 represents an input portion.

As a matter of course, when the image-forming apparatus according to this example receives a signal, for example, a TV signal, including both image information and audio information, it reproduces voice simultaneously with displaying an image. Circuits and speakers relating to receipt, separation, reproduction, process, storage and the like of audio information that are not directly related to the characteristics of the present invention are omitted from the description.

The function of each section will now be described in accordance with the flow of the image signal.

The TV signal receiving circuit 1013 is a circuit for receiving a TV signal which is transmitted by using a wireless transmission system, such as electric wave or a space optical communication.

The TV signal, to be received, is not limited particularly, and, for example, an NTSC method, a PAL method or an SECAM method may be employed. A TV signal composed of further many number of scanning lines, for example, a so-called high-quality TV typified by, for example, the MUSE method, is a preferred signal source to use the advantage of the foregoing display panel suitable to form a large-area display or a large-number pixel display.

The TV signal received by the TV signal receiving circuit 1013 is transmitted to the decoder 1004.

The TV signal receiving circuit 1012 is a circuit for receiving a TV signal transmitted by using a wired transmission system, such as a coaxial cable or a optical fiber. Similarly to the TV signal receiving circuit 1013, the method of the TV signal, to be received, is not limited particularly. Also the TV signal received by the TV signal receiving circuit 1012 is transmitted to the decoder 1004.

The image input interface circuit 1011 is a circuit for receiving an image signal supplied from an image input apparatus, such as a TV camera or an image reading scanner. The received signal is transmitted to the decoder 1004.

The image memory interface circuit 1010 is a circuit for receiving an image signal stored in a video tape recorder (hereinafter called a "VTR"). The received image signal is transmitted to the decoder 1004.

The image memory interface circuit 1009 is a circuit for receiving an image signal stored in a video disk. The received signal is transmitted to the decoder 1004.

The image memory interface circuit 1008 is a circuit for receiving an image signal from an apparatus, such as a still image disk, for storing still image data. The received still image data is supplied to the decoder 1004.

The input/output interface circuit 1005 is a circuit for establishing the connection between the apparatus according to this example and an external computer, a computer network or a printer. As a matter of course, the input/output interface circuit 1005 inputs/outputs image data, character and graphic information and is, sometimes, enabled to input/output a control signal or numerical data to and from the CPU 1006 of the image-forming apparatus according to this example.

The image generating circuit 1007 is a circuit for generating image data to be displayed in accordance with image data, character and graphic information supplied from outside through the input/output interface circuit 1005 or image data, character and graphic information transmitted by the CPU 1006. The image generating circuit 1007 includes circuits required to generate an image, such as a write-enabled memory for storing, for example, image data, character and graphic information, a read-only memory storing image patterns corresponding to character codes, and a processor for performing an image process.

Image data, to be displayed, which has been generated by the foregoing circuit is transmitted to the decoder 1004. The image data can be transmitted to the external computer network or the printer through the input/output interface circuit 1005.

The CPU 1006 mainly performs operations concerning the control of the operation of the display apparatus according to this example, generation, selection and edition of the image to be displayed.

For example, the CPU 1006 transmits a control signal to the multiplexer 1003 to appropriately select or combine image signals to be displayed on the display panel. At this time, the CPU 1006 transmits the control signal to the display panel controller 1002 in accordance with the image signal to be displayed to appropriately control the operation of the display apparatus such that the image display frequency, the scanning method (for example, whether interlace method or non-interlace method) and the number of scanning lines for one frame are instructed. Furthermore, the CPU 1006 directly transmits image data, character and graphic information to the image generating circuit 1007 or accesses an external computer or a memory through the input/output interface circuit 1005 to input image data, character and graphic information.

Note that the CPU 1006 may perform other operations. For example, the CPU 1006 may directly concern the function, for example, a personal computer or a word processor, which generates or processes information. As an alternative to this, the CPU 1006 may be connected to an external computer network through the input/output interface circuit 1005 to perform an operation, such as numerical calculations, in cooperation with an external unit.

The input portion 1014 is used by a user to input a command, a program or data to the CPU 1006, the input portion 1014 being any of a variety of input units, for example, a keyboard, a mouse, a joy stick, a bar code reader, or a voice recognition apparatus.

The decoder 1004 is a circuit for inversely converting a variety of image signals supplied from the image generating circuit 1007 to the TV signal receiving circuit 1013 into three primary signals or a brightness signal and an I-signal and a Q-signal. As indicated by a dashed line, it is preferable that the decoder 1004 includes an image memory. The reason for this is to use a TV signal, such as that of the MUSE method, which requires the image memory when the inverse conversion is performed.

If the image memory is provided, a still image can easily be displayed. As an alternative to this, image processes and edition of images, such as thinning, interpolation, enlargement, contraction and synthesis of images, can easily be performed.

The multiplexer 1003 appropriately selects an image to be displayed in response to the control signal supplied from the CPU 1006. That is, the multiplexer 1003 selects a desired image signal from the inversely converted image signals supplied from the decoder 1004 to transmit the selected image signal to the drive circuit 1001. In the foregoing case, selection of the image signal within a period for displaying one frame enables one frame to be divided into a plurality of regions to display different images on the divided display regions, as has been enabled by a multi-screen TV unit.

The display panel controller 1002 is a circuit for controlling the operation of the drive circuit 1001 in response to the control signal supplied from the CPU 1006.

As an operation concerning the basic operation of the display panel, the display panel controller 1002 transmits, to the drive circuit 1001, a signal for controlling, for example, the operation sequence of a power source (not shown) for operating the display panel. As an operation concerning the method of operating the display panel, the display panel controller 1002 transmits, to the drive circuit 1001, a signal for controlling, for example, the frequency of the image display or the scanning method (whether interlace or non-interlace). The display panel controller 1002 sometimes transmits, to the drive circuit 1001, a control signal relating to adjustment of the image quality, such as the brightness, contrast, color tone and the sharpness of the image to be displayed.

The drive circuit 1001 is a circuit for generating a drive signal to be supplied to the display panel 201. The drive circuit 1001 is operated in response to the image signal supplied from the multiplexer 1003 and the control signal supplied from the display panel controller 1002.

The function of each of the sections is arranged as described above. The image-forming apparatus according to this example and having the structure shown in FIG. 22 is able to display image information supplied from any of a variety of image information sources on the display panel 201. That is, any of a variety of image signals, typified by that of TV broadcast, is inversely converted in the decoder 1004, and then appropriately selected in the multiplexer 1003. Then, the selected signal is supplied to the drive circuit 1001. On the other hand, the display panel controller 1002 generates a control signal for controlling the operation of the drive circuit 1001 in response to the image signal to be displayed. The drive circuit 1001 supplies a drive signal to the display panel 201 in response to the foregoing image signal and the control signal. As a result, an image can be displayed on the display panel 201. A sequence of the foregoing operations are totally controlled by the CPU 1006.

The image-forming apparatus according to the present invention is able to display selected information in the image memory included in the decoder 1004, that generated by the image generating circuit 1007 and supplied information. Furthermore, the image-forming apparatus according to the present invention is able to perform an image process, such as enlargement, contraction, rotation, movement, edge highlighting, thinning, interpolation, color conversion, conversion of the aspect ratio of an image and an image edition, such as synthesis, deletion, connection, substitution and addition. Although omitted from the description about this example, a circuit for only processing or editing voice information may be provided similarly to the foregoing image process and the image edition.

Therefore, the image-forming apparatus according to this example is able to serve, as one unit, as a display unit for a TV broadcast, a terminal unit of a TV conference system, an image edition unit using a still image or a kinetic image, terminal equipment for a computer, terminal equipment for an office, such as a word processor, and a game machine. Thus, a significantly wide applicable range can be realized for industrial and personal use.

Note that FIG. 27 shows only an example of the image-forming apparatus comprising the display panel, the electron beam source is composed of the surface conduction electron-emitting device. As a matter of course, the image-forming apparatus according to the present invention is not limited to this.

For example, among the components shown in FIG. 22, circuits concerning functions which are not required to satisfy the object for use may be omitted. On the contrary, another component may be added as the need arises. For example, in the case where the display apparatus according to the present invention is used as a TV telephone set, it is preferable that a TV camera, a microphone, a light irradiation unit and a transmission/receipt circuit including a modem are added.

Since the image-forming apparatus according to the present invention comprises the electron source formed by the surface conduction electron-emitting device, the display panel can be thinned and, therefore, the depth of the image-forming apparatus can be reduced. Furthermore, since the display panel having the electron beam source formed by the surface conduction electron-emitting device enables the size of the screen to be easily enlarged, excellent brightness to be realized and satisfactory visual field characteristic to be obtained, the image-forming apparatus according to the present invention is able to display an image with feeling of being at a live performance and dynamism.

As described above, according to the present invention, the electron-emitting portion has the electric field which is sufficiently large and formed in parallel to the substrate to emit electrons, and the portion near the electron-emitting portion is able to prevent falling of electrons onto the electrode so that a very efficient electron-emitting device is obtained.

The large-area electron source formed by disposing a multiplicity of the electron-emitting devices is able to improve the electron-emitting efficiency of each electron-emitting device. The image-forming apparatus comprising the foregoing electron source is able to improve the brightness and raise the contrast so that the quality of the image is significantly improved.

The realized improvement in the electron-emitting efficiency enables a low-cost apparatus to be provided, the power consumption of which can be reduced and which has the peripheral circuits, the load of which can be reduced.

As described above, according to the present invention, a large-area flat display can be realized which is capable to adapting to a color image, and which exhibits excellent brightness and high contrast and excellent image quality.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An electron-emitting apparatus comprising an anode electrode and an electron-emitting device disposed on a substrate, said anode electrode being disposed above said electron-emitting device, and said electron-emitting device including:

first and second electrodes disposed on said substrate, which are opposite to each other;

a conductive film connected to said first and second electrodes and having an electron-emitting portion including a fissure; and a field correction electrode disposed on said substrate and spaced from said first and second electrodes, wherein said second electrode is disposed between said first electrode and said field correction electrode, a lower potential is applied to one of said first and second electrodes and a higher potential to the other of said first and second electrodes, and capable of causing a singular point of an electric field, said singular point being generated by application of voltage between said first and second electrodes and application of a potential higher than those applied to the first and second electrode to said anode electrode, to approach said fissure by independently applying to said field correction electrode a field-correcting potential, said field-correcting potential being higher than said lower potential.

2. An electron-emitting apparatus according to claim 1, wherein said field correction electrode is disposed above a plane on which said lower potential side electrode and said higher potential side electrode are formed.

3. An electron-emitting apparatus according to claim 1, wherein said field correction electrode is disposed lower than a plane on which said lower potential side electrode and said higher potential side electrode are formed.

4. An electron-emitting apparatus according to claim 1, wherein said field correction electrode is disposed on a plane inclined with respect to a plane on which said lower potential side electrode and said higher potential side electrode are formed.

5. An electron-emitting apparatus according to claim 1, wherein distance xs from a central portion of said fissure to said singular point of an electric field formed on said higher potential side electrode is shorter than a product of distance L from said central portion of said fissure to a position, at which an electron is initially emitted into a vacuum, and parameter C defined by the following equation:

$$C = \exp\left\{-5.6\left(\frac{eVf}{Wf + eVf}\right)^2 + 27.3\left(\frac{eVf}{Wf + eVf}\right) - 12.2\right\}$$

where Vf (in volts) is a voltage to be applied between said lower potential side electrode and said higher potential side electrode, Wf (in electron volts) is a work function of a substance near said fissure and e (in coulombs) is the elementary electric charge, and assuming that a voltage to be applied to said field correction electrode with respect to said lower potential side electrode is Vc, the distance xs is approximately given by the following equation:

$$x_s = \frac{hVf}{\pi\left(Va + \frac{h}{\pi b}Vc\right)}$$

where h is the distance from said electron-emitting device to said anode electrode, π is the ratio of the circumference of a circle to its diameter, Va is the voltage to be applied to said anode electrode and b is the distance from said central portion of said fissure to a central portion for a gap between said field correction electrode and whichever of said lower potential side electrode and said higher potential side electrode is nearer to said field correction electrode.

6. An electron-emitting apparatus according to claim 5, wherein Va and Vc are changed during a lapse of time maintaining the following parameter at a constant value:

$$Va + hVc/(\pi b).$$

7. An electron-emitting apparatus according to claim 5, wherein Vf and Vc are synchronously changed during a lapse of time to make a value of emission current constant.

8. An electron-emitting apparatus according to any one of claims 1–7 comprising a plurality of said electron-emitting devices on a substrate.

9. An electron-emitting apparatus according to claim 8, wherein said plurality of electron-emitting devices are disposed in the form of a matrix, said apparatus further comprising a plurality of row wires and a plurality of column wires, and wherein either side of each of said electron-emitting devices is connected to a row wire and another side of each of said electron-emitting devices is connected to a column wire perpendicular to said row wire.

10. An electron-emitting apparatus according to claim 8, wherein said plurality of electron-emitting devices are, on a substrate, disposed in a ladder-like configuration, two ends of each of said electron-emitting devices are, in parallel, connected to two row wires, and said field correction electrode is connected to a column wire perpendicular to said row wires.

11. An image-forming apparatus comprising an anode electrode and an electron-emitting device disposed on a substrate, said anode electrode including an image-forming member and being disposed above said electron-emitting device, and said electron-emitting device including:

first and second electrodes disposed on said substrate, which are opposite to each other;

a conductive film connected to said first and second electrodes and having an electron-emitting portion including a fissure; and a field correction electrode disposed on said substrate and spaced from said first and second electrodes, wherein said second electrode is disposed between said first electrode and said field correction electrode, a lower potential is applied to one of said first and second electrodes and a higher potential to the other of said first and second electrodes, and capable of causing a singular point of an electric field to approach said fissure by independently supplying to said field correction electrode a field-correcting potential higher than said lower potential.

12. An image-forming apparatus according to claim 11, wherein said image-forming member comprises a fluorescent member.

13. An image-forming apparatus according to claim 11, wherein said field correction electrode is disposed upper than a plane on which said lower potential side electrode and said higher potential side electrode are formed.

14. An image-forming apparatus according to claim 11, wherein said field correction electrode is disposed lower than a plane on which said lower potential side electrode and said higher potential side electrode are formed.

15. An image-forming apparatus according to claim 11, wherein said field correction electrode is disposed on a plane inclined with respect to a plane on which said lower potential side electrode and said higher potential side electrode are formed.

16. An image-forming apparatus according to claim 11, wherein distance xs from a central portion of said fissure to said singular point of an electric field formed on said higher potential side electrode is shorter than a product of distance L from said central portion of said fissure to a position, at which an electron is initially emitted into a vacuum, and parameter C defined by the following equation:

$$C = \exp\left\{-5.6\left(\frac{eVf}{Wf + eVf}\right)^2 + 27.3\left(\frac{eVf}{Wf + eVf}\right) - 12.2\right\}$$

where Vf (in volts) is a voltage to be applied between said lower potential side electrode and said higher potential side electrode, Wf (in electron volts) is a work function of a substance near said fissure and e (in coulombs) is the elementary electric charge, and assuming that voltage to be applied to said field correction electrode with respect to said lower potential side electrode is Vc, the distance xs is approximately given by the following equation:

$$x_s = \frac{hVf}{\pi\left(Va + \frac{h}{\pi b}Vc\right)}$$

where h is the distance from said electron-emitting device and said anode electrode, π is the ratio of the circumference of a circle to its diameter, Va is the voltage to be applied to said anode electrode and b is the distance from said central portion of said fissure to a central portion of a gap between said field correction electrode and said lower potential side electrode or said higher potential side electrode to which said field correction electrode is disposed adjacent.

17. An image-forming apparatus according to claim 16, wherein Va and Vc are changed during a lapse of time maintaining the following parameter at a constant value:

$$Va + hVc/(\pi b).$$

18. An image-forming apparatus according to claim 16, wherein Vf and Vc are synchronously changed during a lapse of time to make a value of emission current to be constant.

19. An image-forming apparatus according to any one of claims 11, 13–18, further comprising a plurality of said electron-emitting devices on a substrate.

20. An image-forming apparatus according to claim 19, wherein said plurality of electron-emitting devices are disposed in the form of a matrix, either side of each of said electron-emitting devices is connected to a row wire and another side of each of said electron-emitting devices is connected to a column wire perpendicular to said row wire.

21. An image-forming apparatus according to claim 19, wherein said plurality of electron-emitting devices are, on a substrate, disposed in a ladder-like configuration, two ends of each of said electron-emitting devices are, in parallel, connected to two row wires, and said field correction electrode is connected to a column wire perpendicular to said row wire.

* * * * *

UNITED STATES PATENT AND TRADEMARK OFFICE

CERTIFICATE OF CORRECTION

PATENT NO. : 6,262,701 B1
DATED : July 17, 2001
INVENTOR(S) : Masahiro Okuda et al.

It is certified that error appears in the above-identified patent and that said Letters Patent is hereby corrected as shown below:

Column 3,
Line 32, “advantage” should read -- advantages --.

Column 5,
Line 65, “electron” should read -- electrons --; and
“and” should read -- a --.

Column 6,
Line 46, “substances” should read -- substance --.

Column 8,
Line 11, “falls” should read -- fall --; and
Line 51, “electron” should read -- electrons --.

Column 10,
Line 33, “electron” should read -- electrons --.

Column 11,
Line 10, “$\pi bV_a$-” should read -- $\pi bV_a$+ --.

Column 12,
Line 16, “of” should read -- of a --; and
Line 21, “are” should read -- is --.

Column 14,
Line 40, “chracteristic” should read -- characteristics --.

Column 15,
Line 19, “device.” should read -- device --.

Column 17,
Line 6, “enables” should read -- enable --; and
Line 41, “insulating” should read -- insulate --.

UNITED STATES PATENT AND TRADEMARK OFFICE

CERTIFICATE OF CORRECTION

PATENT NO. : 6,262,701 B1
DATED : July 17, 2001
INVENTOR(S) : Masahiro Okuda et al.

It is certified that error appears in the above-identified patent and that said Letters Patent is hereby corrected as shown below:

Column 20,
Line 34, "actual," should read -- actuality, --.

Column 23,
Line 39, "electrode" should read -- electrodes --.

Column 28,
Line 6, "is" should read -- was --.

Column 30,
Line 2, "forming" should read -- forming an --.

Column 31,
Line 16, "Then," should read -- Then, a --.

Column 32,
Line 1, "circuit," should read -- circuits, --; and
Line 3, "circuit," should read -- circuits, --.

Signed and Sealed this

Twenty-ninth Day of July, 2003

JAMES E. ROGAN
*Director of the United States Patent and Trademark Office*